US012534846B2

(12) United States Patent
Bixby et al.

(10) Patent No.: US 12,534,846 B2
(45) Date of Patent: Jan. 27, 2026

(54) LAUNDRY APPLIANCE HAVING LAUNDRY ACCESSORIES

(71) Applicant: WHIRLPOOL CORPORATION, Benton Harbor, MI (US)

(72) Inventors: Seth E. Bixby, Stevensville, MI (US); Mark Jason Christensen, Stevensville, MI (US); Marco Ali Curti Espinosa, Nueno Leon (MX); Yu Liu, St. Joseph, MI (US); Sergio Moreno, Apodaca (MX); Sayer James Murphy, St. Joseph, MI (US); Jonathan D. Pugh, Benton Harbor, MI (US); Bruno T. Ramasco, Stevensville, MI (US); Nicholas C. Schooley, Coloma, MI (US); Meagan Kathleen VanderVelde, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 917 days.

(21) Appl. No.: 17/723,612

(22) Filed: Apr. 19, 2022

(65) Prior Publication Data

US 2022/0349111 A1 Nov. 3, 2022

Related U.S. Application Data

(60) Provisional application No. 63/183,205, filed on May 3, 2021.

(51) Int. Cl.

| | |
|---|---|
| ***D06F 57/08*** | (2006.01) |
| ***A47B 3/02*** | (2006.01) |
| ***D06F 29/00*** | (2006.01) |
| ***D06F 35/00*** | (2006.01) |
| ***D06F 37/00*** | (2020.01) |

(Continued)

(52) U.S. Cl.

CPC ..... *D06F 58/203* (2013.01); *D06F 57/00* (2013.01); *D06F 58/02* (2013.01); *D06F 58/10* (2013.01)

(58) Field of Classification Search

CPC ..... D06F 58/203; D06F 57/08; F06F 59/00; F06F 29/00

See application file for complete search history.

(56) References Cited

U.S. PATENT DOCUMENTS

| | | | |
|---|---|---|---|
| 3,926,315 | A | 12/1975 | Bernard |
| 4,003,138 | A | 1/1977 | Wicks |

(Continued)

FOREIGN PATENT DOCUMENTS

| | | |
|---|---|---|
| CN | 1311368 A | 9/2001 |
| CN | 101328658 | 12/2008 |

(Continued)

OTHER PUBLICATIONS

English KR20060060211 by PE2E May 21, 2025.*
English WO2016024786 by PE2E Sep. 4, 2025.*

*Primary Examiner* — Deming Wan
(74) *Attorney, Agent, or Firm* — Price Heneveld LLP

(57) ABSTRACT

A laundry appliance includes a cabinet. A blower is disposed within the cabinet that delivers accessory air through an accessory airflow path. An accessory bar assembly is in fluid communication with the accessory airflow path. The accessory bar assembly is configured to suspend articles therefrom and to provide the accessory air for conditioning the articles.

20 Claims, 17 Drawing Sheets

(51) Int. Cl.

| | |
|---|---|
| ***D06F 57/00*** | (2006.01) |
| ***D06F 58/02*** | (2006.01) |
| ***D06F 58/10*** | (2006.01) |
| ***D06F 58/20*** | (2006.01) |

(56) References Cited

U.S. PATENT DOCUMENTS

| | | | | |
|---|---|---|---|---|
| 5,181,685 | A | 1/1993 | Ostapowicz | |
| 7,954,914 | B2 | 6/2011 | Kendall et al. | |
| 8,479,542 | B2 | 7/2013 | Kendall et al. | |
| 8,499,472 | B2 | 8/2013 | Bari et al. | |
| 8,578,639 | B2 | 11/2013 | Hurd | |
| 8,595,952 | B2 | 12/2013 | Browne et al. | |
| 9,850,611 | B2 | 12/2017 | Lee et al. | |
| 10,100,459 | B2 | 10/2018 | Groppel | |
| 10,519,592 | B2 | 12/2019 | Del Pos et al. | |
| 10,774,464 | B2 | 9/2020 | Bensel et al. | |
| 11,021,836 | B2 | 6/2021 | Shin et al. | |
| 2005/0050754 | A1 | 3/2005 | Deblois | |
| 2007/0266740 | A9 * | 11/2007 | Kendall | D06F 29/00 68/3 R |
| 2012/0293052 | A1 | 11/2012 | Stegerwald | |
| 2019/0257024 | A1 | 8/2019 | Shin et al. | |
| 2020/0063330 | A1 | 2/2020 | Kim et al. | |
| 2021/0002811 | A1 | 1/2021 | Bellinger et al. | |

FOREIGN PATENT DOCUMENTS

| | | | | | |
|---|---|---|---|---|---|
| CN | 102677418 | | | 9/2012 | |
| CN | 105970564 | | | 9/2016 | |
| CN | 106835606 | | | 6/2017 | |
| CN | 110878468 | A | | 3/2020 | |
| DE | 3211316 | | | 9/1983 | |
| DE | 102011002330 | | | 1/2012 | |
| EP | 1431442 | | | 6/2004 | |
| EP | 1854916 | A1 | | 11/2007 | |
| EP | 2194184 | | | 12/2008 | |
| EP | 3284856 | | | 2/2018 | |
| JP | H01145099 | | | 6/1989 | |
| JP | 107213792 | | | 2/1994 | |
| JP | H06343794 | | | 12/1994 | |
| KR | 20060060211 | A | * | 6/2006 | D06F 58/10 |
| KR | 20090102416 | A | | 9/2009 | |
| WO | WO-2016024786 | A1 | * | 2/2016 | D06F 73/02 |

* cited by examiner

LAUNDRY APPLIANCE HAVING LAUNDRY ACCESSORIES

CROSS-REFERENCE TO RELATED APPLICATION

This application claims priority to and the benefit under 35 U.S.C. § 119(e) of U.S. Provisional Patent Application No. 63/183,205, filed on May 3, 2021, entitled LAUNDRY APPLIANCE HAVING LAUNDRY ACCESSORIES, the entire disclosure of which is hereby incorporated herein by reference.

FIELD OF THE DEVICE

The present disclosure generally relates to a laundry appliance, and more specifically, to a laundry appliance having various laundry accessories.

BRIEF SUMMARY OF THE DEVICE

According to one aspect of the present disclosure, a laundry appliance includes a cabinet. A blower is disposed within the cabinet that delivers accessory air through an accessory airflow path. An accessory bar assembly is in fluid communication with the accessory airflow path. The accessory bar assembly is configured to suspend articles therefrom and to provide the accessory air for conditioning the articles.

According to another aspect of the present disclosure, a vertical axis laundry machine includes a cabinet having a top panel that defines an access opening. A lid is coupled with the top panel and having a lower surface. The lid is operable between a raised position above the access opening and a lowered position that covers the access opening. A removable panel is selectively positioned on the top panel and over the access opening to define a processing state. A heating element is positioned proximate at least one of the lid and the top panel. The heating element is configured to heat at least one of the lower surface of the lid and an upper surface of the removable panel. When the removable panel is in the processing state and the lid is in the lowered position, the lower surface of the lid and the upper surface of the removable panel are pressed together to define a wrinkle processing space for treating articles of clothing.

According to yet another aspect of the present disclosure, a vertical axis laundry machine includes a cabinet that includes a base positioned proximate a lower portion of the cabinet. A drawer is disposed within the base and operable between a stowed position within the base and a supporting position forward of the base. A step is disposed within the drawer. The step is attached to the drawer via a scissor linkage. The step is configured to be operable between a flat position and a step position when the drawer is in the supporting position.

These and other features, advantages, and objects of the present disclosure will be further understood and appreciated by those skilled in the art by reference to the following specification, claims, and appended drawings.

Figure 1A:
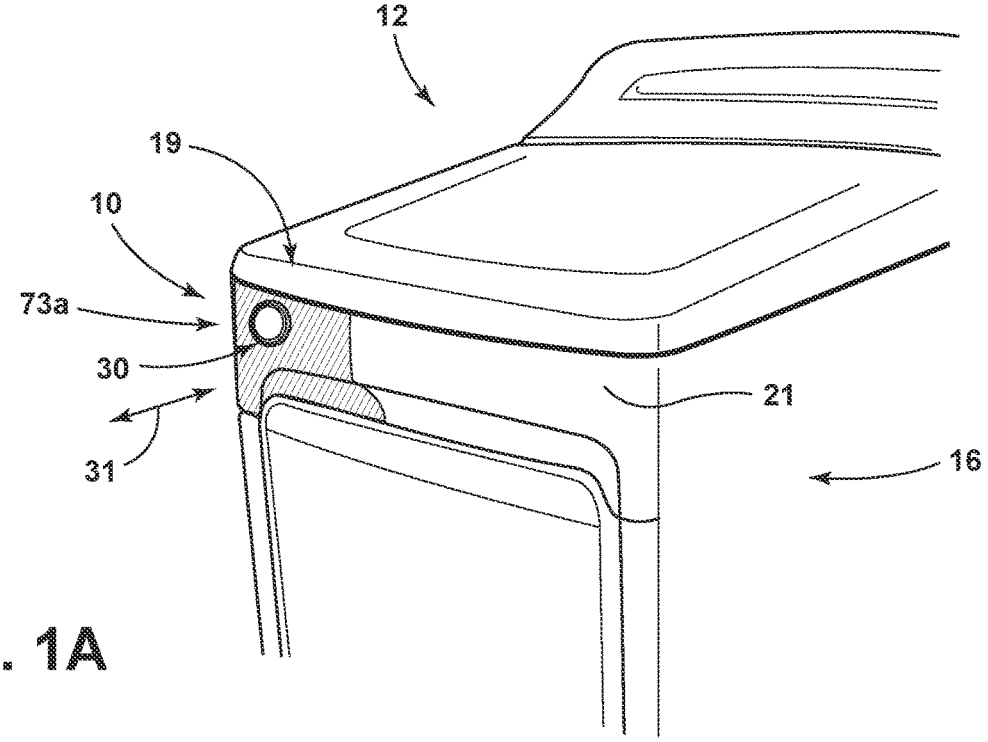
FIG. 1A is a partial, perspective view of a laundry appliance with an accessory bar assembly, shown in a retracted position, according to various aspects described herein.
Figure 1B:
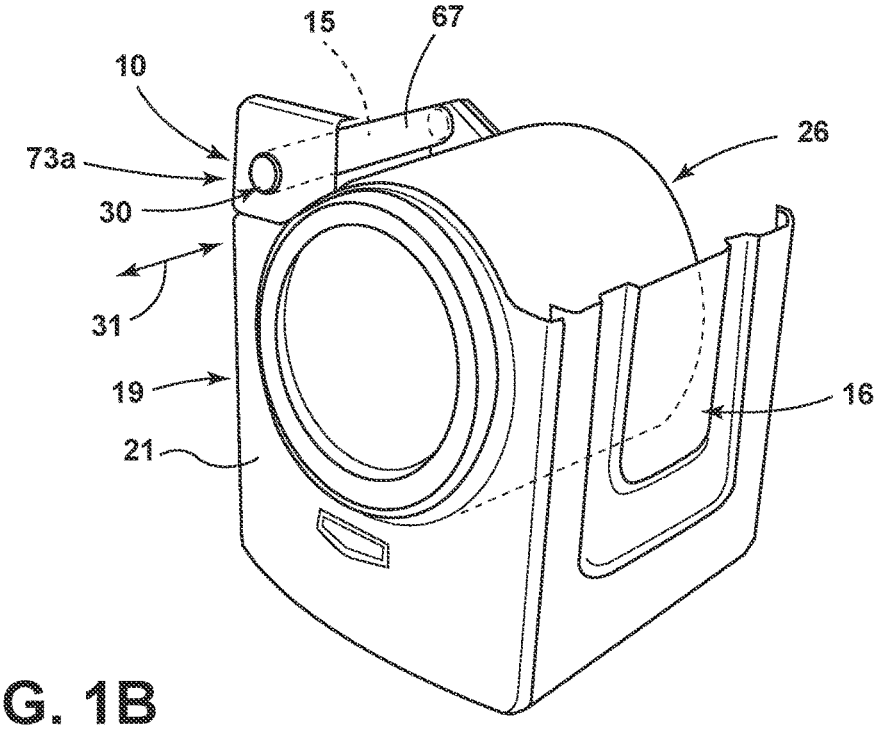
FIG. 1B is a cut-away, perspective view of a laundry appliance with an accessory bar assembly, shown in a retracted position, according to various aspects described herein.
Figure 1C:
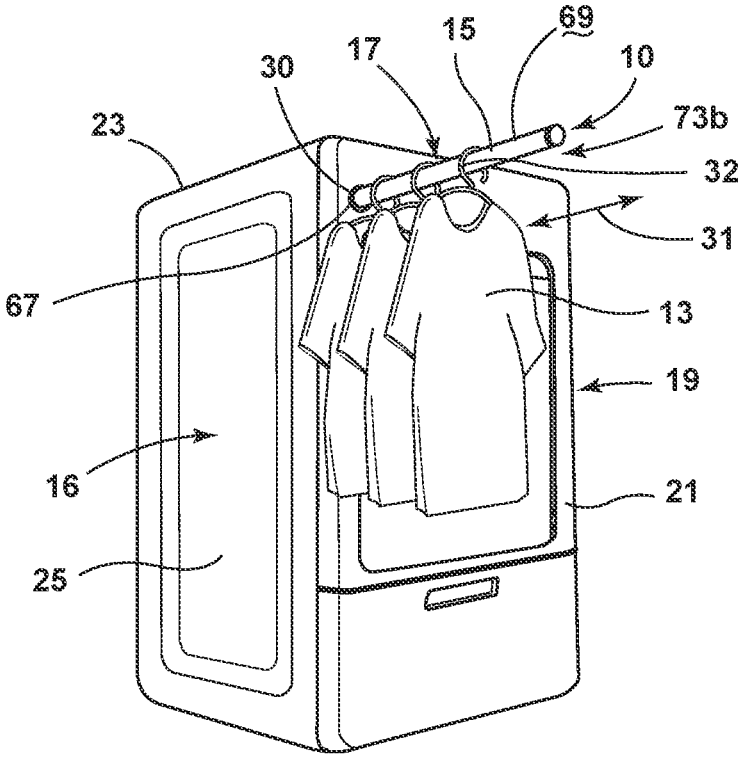
FIG. 1C is a partial, perspective view of a laundry appliance with an accessory bar assembly, shown in an extended position, according to various aspects described herein.
Figure 1D:
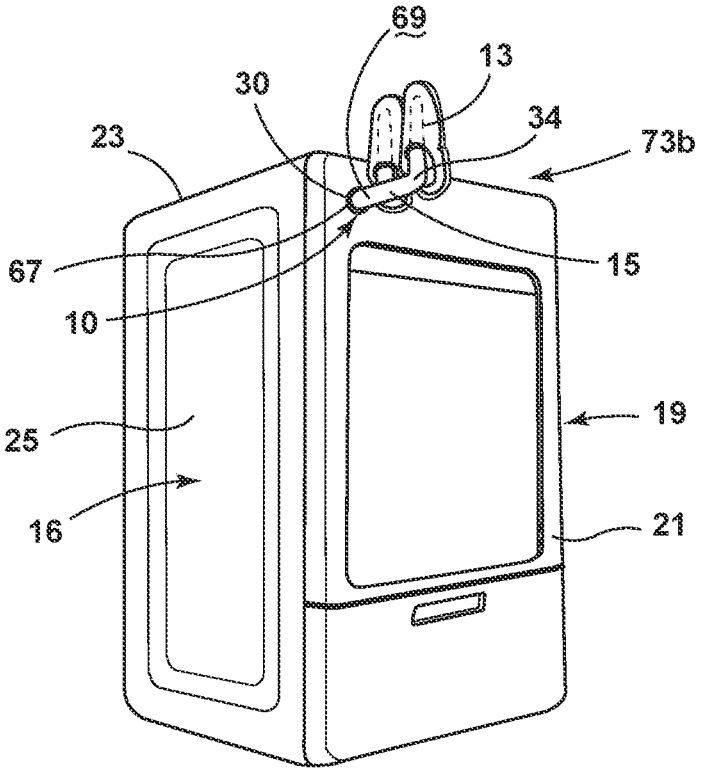
FIG. 1D is a partial, perspective view of a laundry appliance with an accessory bar assembly, shown in an extended position, according to various aspects described herein.

The components in the figures are not necessarily to scale, emphasis instead being placed upon illustrating the principles described herein.

DETAILED DESCRIPTION

The present illustrated embodiments reside primarily in combinations of method steps and apparatus components related to a cooking appliance door push button assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIGS. 1A-13B. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1A-11B, reference numeral 10 generally refers to an accessory bar assembly that is incorporated within a laundry appliance 12, where the accessory bar assembly 10 can be used for supporting and suspending articles 13 in a hanging position. A blower 14 is disposed within a cabinet 16 of the laundry appliance 12. According to various aspects of the device, the blower 14 delivers accessory air 18 through an accessory airflow path 20 in fluid communication with the accessory bar assembly 10. Thus, the accessory bar assembly 10 can provide the accessory air 18 for conditioning the articles 13.

The laundry appliance 12 may be in the form of a dryer, a combination washer and dryer, a washer or other laundry processing appliance. Further, the laundry appliance 12 may be in the form of a vertical axis appliance or a horizontal axis appliance. In some examples, the laundry appliance 12 is in the form of a front-loading dryer.

Figure 2:
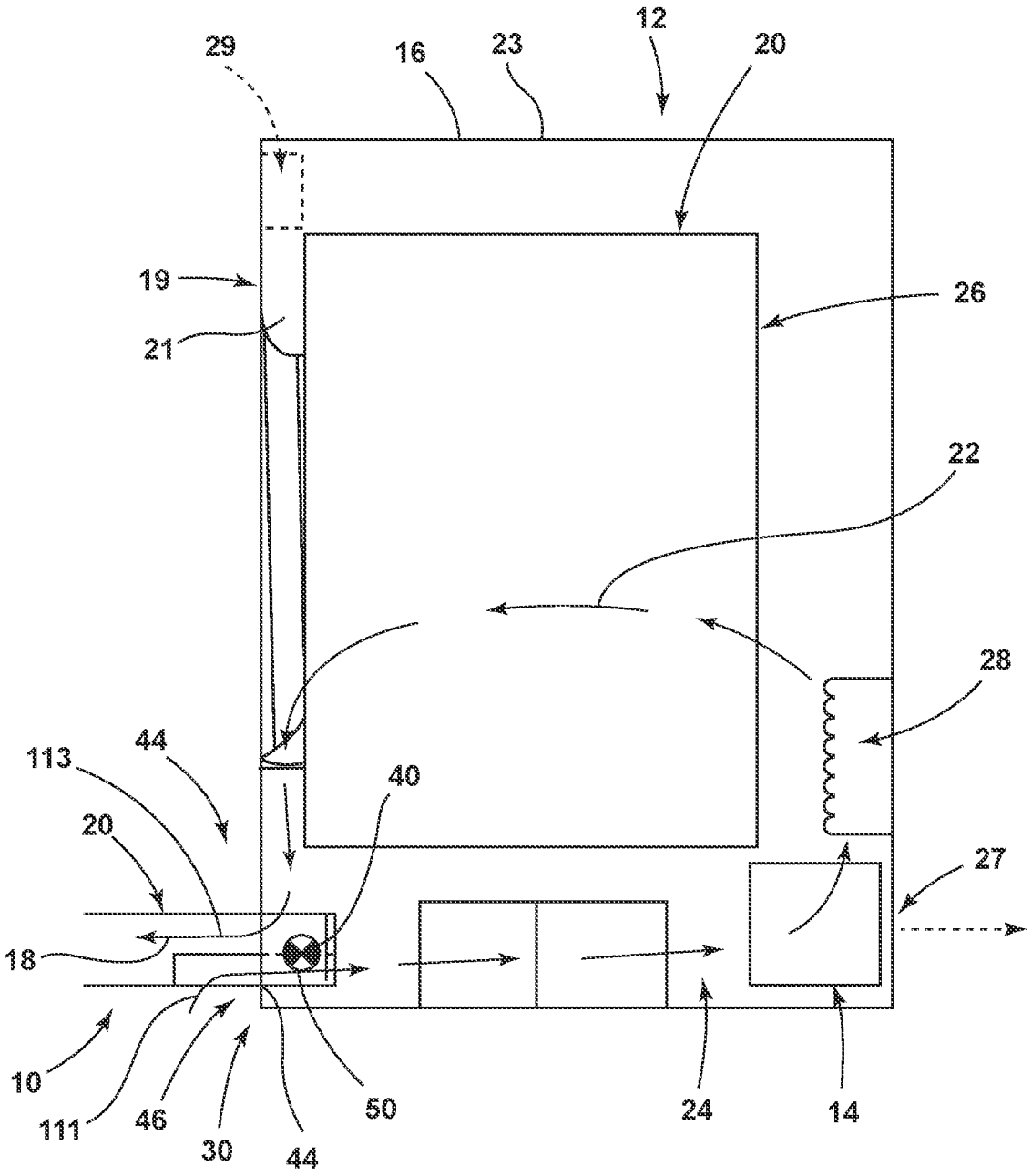
FIG. 2 is a schematic cross-sectional view of a laundry appliance and showing an aspect of the accessory port.

Referring now to FIG. 2, the blower 14 delivers process air 22 through a process airflow path 24. The process airflow path 24 typically moves the process air 22 from the blower 14, through a primary airflow path that includes a rotating drum 26, then through one or more filtration devices and back to the blower 14 or an outlet 27. However, the process air 22 can be diverted from the outlet 27, or the process airflow path 24, and redirected to the accessory airflow path 20. Optionally, the blower 14 can be an independent blower that provides the accessory air 18 to the accessory bar assembly 10. In such an embodiment, the blower 14 is not typically in fluid communication with the process airflow path 24 and a separate primary blower operates to deliver the process air 22 through the primary airflow path.

One or more temperature control mechanisms 28 can be incorporated within the process airflow path 24 and/or the accessory airflow path 20 for providing temperature variation within the process air 22 and/or the accessory air 18. The temperature control mechanisms 28 can be in the form of various heating and cooling devices. Further, one or more humidity, or moisture, control mechanisms can be incorporated within the process airflow path 24 and/or the accessory airflow path 20 for providing water vapor within, and extracting condensate fluid from, the process air 22 and/or the accessory air 18. Thus, the blower 14 can be configured to provide varying temperatures and humidity of accessory air 18 as needed.

For example, the accessory bar assembly 10 may include controls to operate at various temperature settings that can include low, medium and high temperature settings and intermediate temperature variations there between. Likewise, the accessory bar assembly 10 may provide water vapor within the accessory air 18 in order to steam the articles 13 and can include low, medium, and high steam control settings. Therefore, the laundry appliance 12 can include a user interface 29, such as a human machine interface (HMI) configured to accept user input regarding various functionalities of the accessory bar assembly 10 (i.e. speed, heat, and moisture controls). In certain aspects of the device, humid air can be captured during operation of the appliance, such as during a drying cycle, and delivered to the accessory airflow path 20 for directing steam through the accessory bar assembly 10.

An accessory port 30 is coupled with the accessory airflow path 20. The accessory port 30 and its corresponding mechanisms may be integral with the cabinet 16, which can include being positioned entirely within an interior of the cabinet 16, or positioned such that the accessory port 30 is in fluid communication with an exterior of the cabinet 16. In some examples, the accessory port 30 selectively redirects the process air 22 through the accessory airflow path 20. The accessory bar assembly 10 is configured to selectively engage the accessory port 30 to define the accessory airflow path 20. In this manner, when the accessory bar assembly 10 is coupled with the accessory port 30, the accessory air 18 delivered by the blower 14 moves through the accessory port 30 for providing functionality at a particular point, referred to herein as a processing space, using the accessory bar assembly 10. The accessory bar assembly 10 can utilize the movement of the accessory air 18 for accomplishing certain tasks within and around the laundry appliance 12, such as drying or otherwise conditioning the articles 13 (i.e. refreshing, de-wrinkling, warming). In other words, the accessory bar assembly 10 can produce a drying airflow in the processing space that is typically an area external to the cabinet 16 of the appliance 12. Typically, the accessory bar assembly 10 utilizes the accessory air 18 in the form of a positive airflow, (i.e., blowing air), but it is within the scope of the disclosure for the accessory bar assembly 10 to utilize negative airflow (i.e., vacuum).

The accessory bar assembly 10 may include any suitable configuration, including combinations and permutations of configurations disclosed herein. According to some aspects, the accessory bar assembly 10 may be in the form of a rail 15 (FIG. 1C) configured in the form of a hanging-clothes dryer 17. This hanging-clothes dryer 17 can receive a hanger 32 for hanging the articles 13. The shape of the rail 15 as will be described further herein can be any one of various extruded shapes, such as a cylinder, a rectangular prism or other similar polygonal prism, arcuate, angled, irregular, and other similar shapes. In another example, the accessory bar assembly 10 is in the form of a rail 15 including pegs 34 configured as a footwear dryer to receive the articles 13, which may be shoes, boots, slippers and the like.

Figure 3:
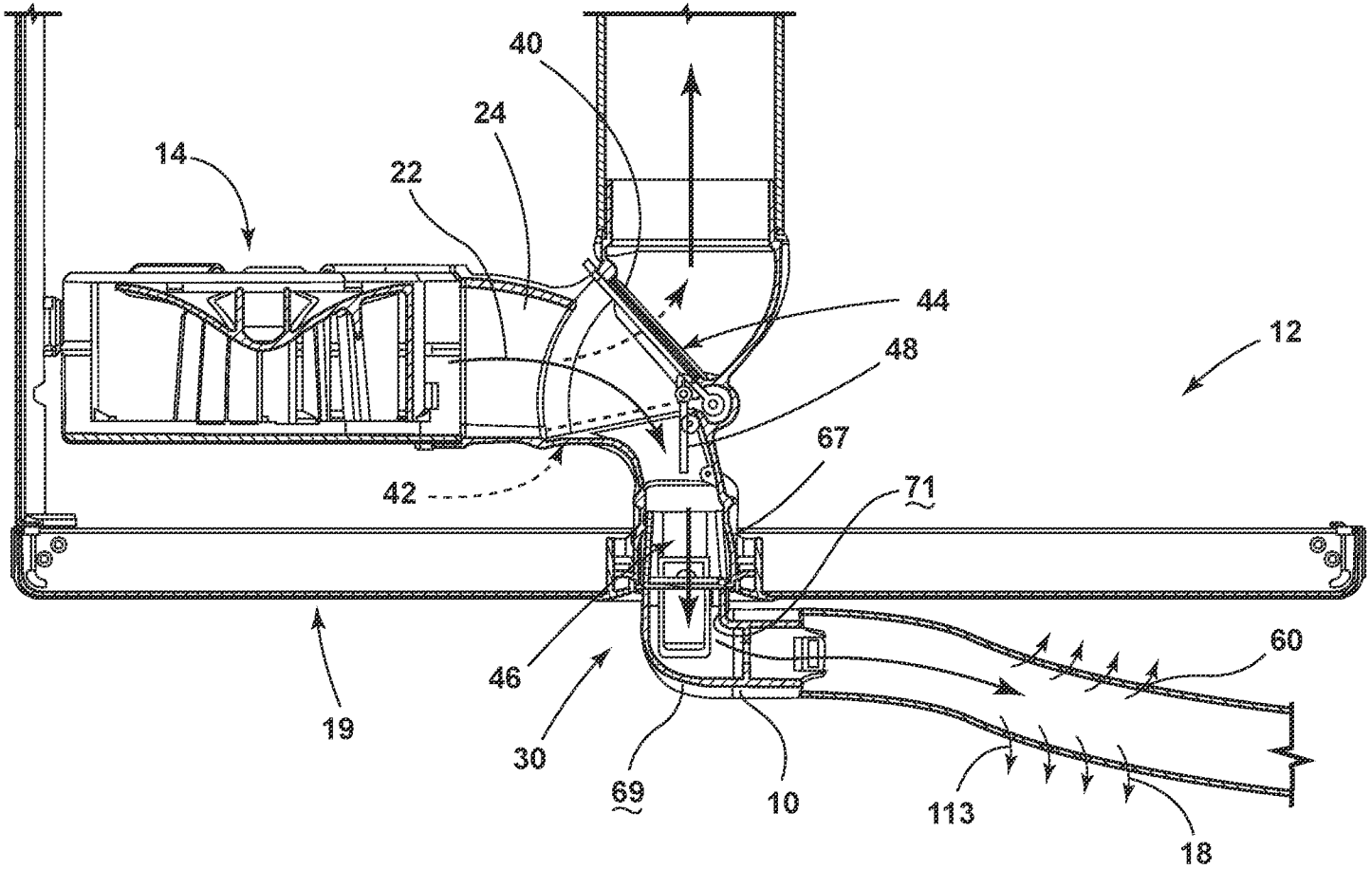
FIG. 3 is a schematic cross-sectional view of the laundry appliance showing an aspect of the accessory port.
Figure 4B:
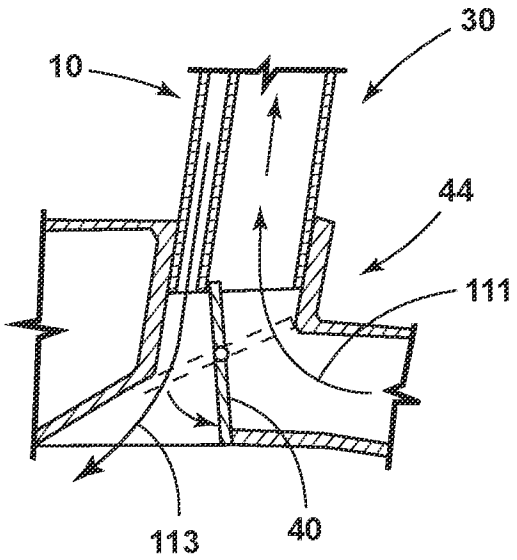
FIG. 4B is a schematic cross-sectional view of the accessory port of FIG. 4A with the baffle moved into an accessory state.
Figure 4A:
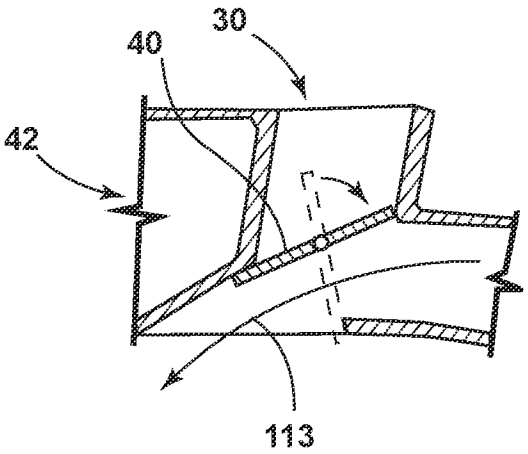
FIG. 4A is a schematic cross-sectional view of an aspect of an accessory port showing a baffle in a standard state.

Referring now to FIGS. 3-4B, where the laundry appliance 12 is a recirculating dryer, the accessory port 30 can include an internal baffle 40 that can be operated to convert the process airflow path 24 from a standard state 42 to an accessory state 44. In the standard state 42, the recirculating dryer operates according to typical operating conditions where clothes, or articles 13, are dried within the rotating drum 26. Conversely, in the accessory state 44, the process air 22 is redirected from the accessory port 30 and through the accessory bar assembly 10 for providing the accessory air 18. Where the baffle 40 is incorporated, the baffle 40 can be selectively biased toward the standard state 42, indicative of a standard or conventional operation condition. Insertion of an aspect of the accessory bar assembly 10 operates to overcome this biasing force and move the baffle 40 to an accessory state 44.

In some examples, the accessory state 44 is indicative of the accessory port 30 receiving the accessory bar assembly 10 through rotation, extension, insertion or other manipulation of the accessory bar assembly 10 with respect to the accessory port 30. In this way, the accessory bar assembly 10 is manipulated with respect to the accessory port 30 and the baffle 40 is operated from the standard state 42 to the accessory state 44. In the standard state 42, as exemplified in FIG. 3, the process airflow path 24 extends from the blower 14, through the rotating drum 26, past the accessory port 30, which is in the standard state 42, and back to the blower 14. As discussed above, various temperature control mechanisms 28 can be disposed within and around the accessory airflow path 20 and the process airflow path 24.

As illustrated in FIG. 3, in an exemplary and non-limiting aspect of the device, an interface 46 engages a baffle actuator 48 that biases the baffle 40 to the accessory state 44. The baffle 40 can be slidably operable within the accessory port 30 and biased by a biasing mechanism toward the standard state 42. Accordingly, the baffle 40 automatically returns to the standard state 42 when accessory bar assembly 10 is removed from the accessory port 30. The baffle actuator 48 can be a linkage that is physically moved by the insertion or other manipulation of the accessory bar assembly 10 with respect to the accessory port 30. The baffle actuator 48 can also be a motorized or automatically operated member, such as diverter valve 50.

According to various aspects of the device, the accessory bar assembly 10 is configured to attach to or deploy from accessory port 30 on the cabinet 16. In some implementations, the accessory bar assembly 10 is configured to slide in and out of the accessory port 30 to define a storage position 73*a* and a use position 73*b*, respectively. It is contemplated that the accessory bar assembly 10 can be positioned to attach to the cabinet 16 at various locations and positions. Accordingly, the accessory bar assembly 10 can attach to a front portion 19 of the cabinet 16. The front portion 19 of the cabinet 16 can include one or more of a front panel 21, a top panel 23, a side panel 25, seams or junctions therebetween, as well as other similar locations relative to the front portion 19 of the cabinet 16. It is contemplated that depending on the configuration of the accessory bar assembly 10 and the accessory airflow path 20, the accessory port 30 can be positioned at other locations of the cabinet 16 that are within, or distal from, the front portion 19 of the cabinet 16. Thus, the accessory state 44 can be indicative of the accessory bar assembly 10 extending from the accessory port 30 in the use position 73*b*, which is generally shown in FIGS. 1A-11B. The motion of the accessory bar assembly 10 to the accessory state 44, as described herein, can be in a linear motion 31, a rotational motion 33 as well as a combination of linear and rotational movements.

Figure 5A:
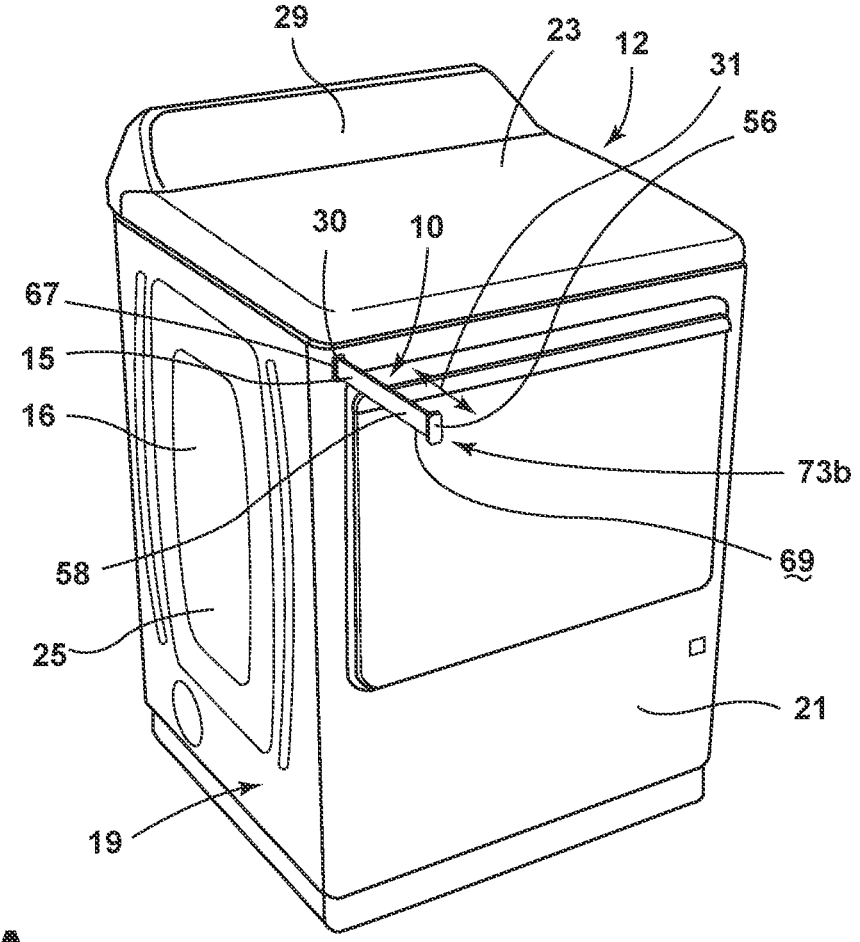
FIG. 5A is a perspective view of a laundry appliance with an accessory bar assembly, shown in an extended position, according to various aspects described herein.
Figure 5B:
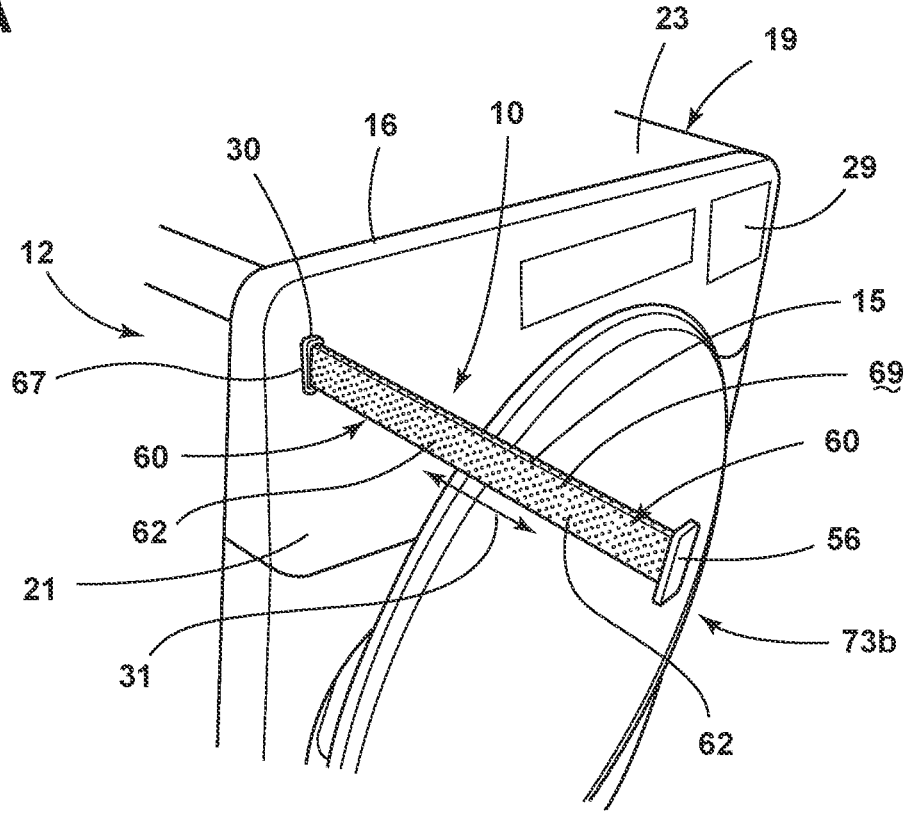
FIG. 5B is a partial, perspective view of a laundry appliance with the accessory bar assembly of FIG. 5A according to various aspects described herein.

Referring now to FIGS. 5A and 5B, an exemplary accessory bar assembly 10 in the form of a rail 15 is illustrated. The accessory bar assembly 10 can slide through a linear motion 31 in and out of the accessory port 30 on the cabinet 16 to define the storage and use positions 73*a*, 73*b*, respectively. FIGS. 5A and 5B illustrate the accessory bar assembly 10 in various use positions 73*b*, which may include variable distances that the accessory bar assembly 10 is extended from the accessory port 30 of the cabinet 16. In some examples, the user can pull the accessory bar assembly 10 to extend it from the cabinet 16 to any one of a plurality of use positions 73*b*. Alternatively, a user can manipulate the accessory bar assembly 10 to eject, or extend, the accessory bar assembly 10 from the cabinet 16. A push-latch mechanism may be provided to extend the accessory bar assembly 10 upon pushing by the user.

Various aspects of the accessory bar assembly 10 can include an end portion 56 to facilitate manipulation, by pushing, pulling and rotating, by the user. The end portion 56 can be sized larger than a body 58 of the accessory bar assembly 10, which can prevent the articles 13 from sliding off. Optionally, the user can input a control signal that the laundry appliance 12 can process as a use position request. This control signal can result in the laundry appliance 12 controlling the accessory bar assembly 10 to extend, or eject, from the accessory port 30 using a motor or other actuator. Likewise, a user can input a control signal that the laundry appliance 12 can process as a storage position request. This control signal can result in the laundry appliance 12 controlling the motor or actuator of the accessory bar assembly 10 to retract the accessory bar assembly 10 into the accessory port 30.

The accessory bar assembly 10, can include a plurality of outlets 60 configured to provide the accessory air 18. The outlets 60 can be in the form of vents 62, such as a plurality of perforations or micro-perforations of various sizes and configurations, slots, channels, combinations thereof and other openings through which accessory air 18 can be directed. As illustrated, the vents 62 are disposed throughout the body 58 of the accessory bar assembly 10 such that the body 58 is covered with the vents 62. Accordingly, articles 13 draped over the accessory bar assembly 10, or suspended therefrom, can be dried with the accessory air 18.

These vents 62, as disclosed herein, can have a wide range of shapes, sizes and configurations. In addition, where outlets 60 or vents 62 are described, it should be understood that the outlets 60 and the vents 62 are interchangeable and also can be intermingled with one another in any one or more of the various aspects of the device described herein. The presence or absence of the outlets 60 or the vents 62 is not intended to foreclose the use of one or the other.

Figure 6A:
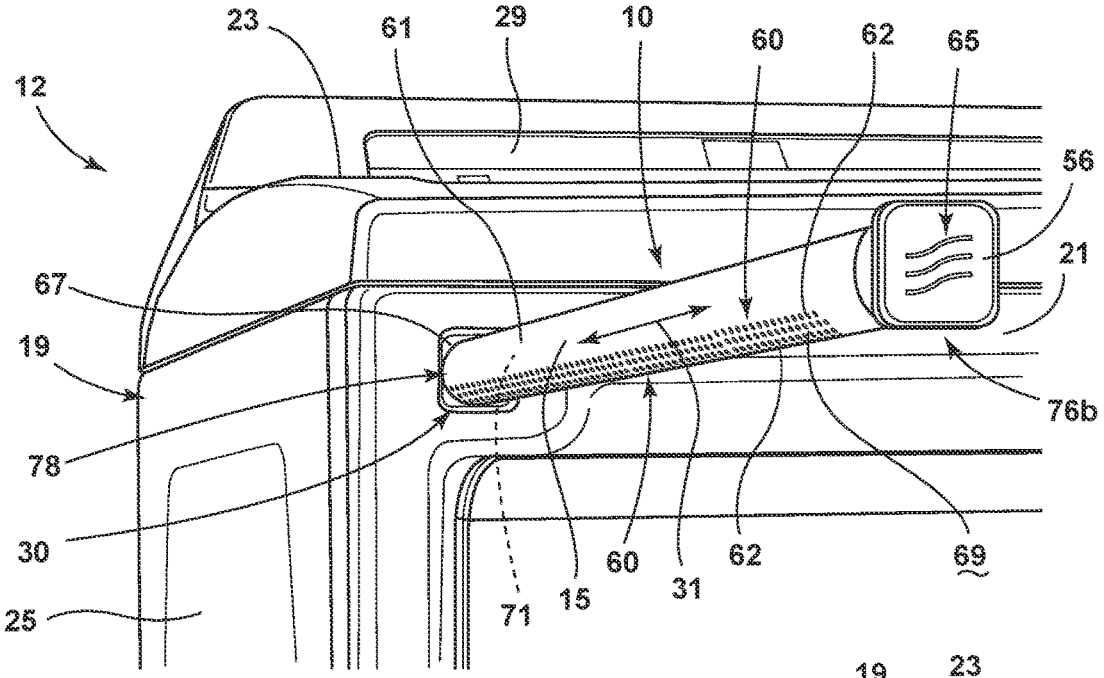
FIG. 6A is a partial, perspective view of a laundry appliance with an accessory bar assembly, shown in an extended position, according to various aspects described herein.
Figure 6B:
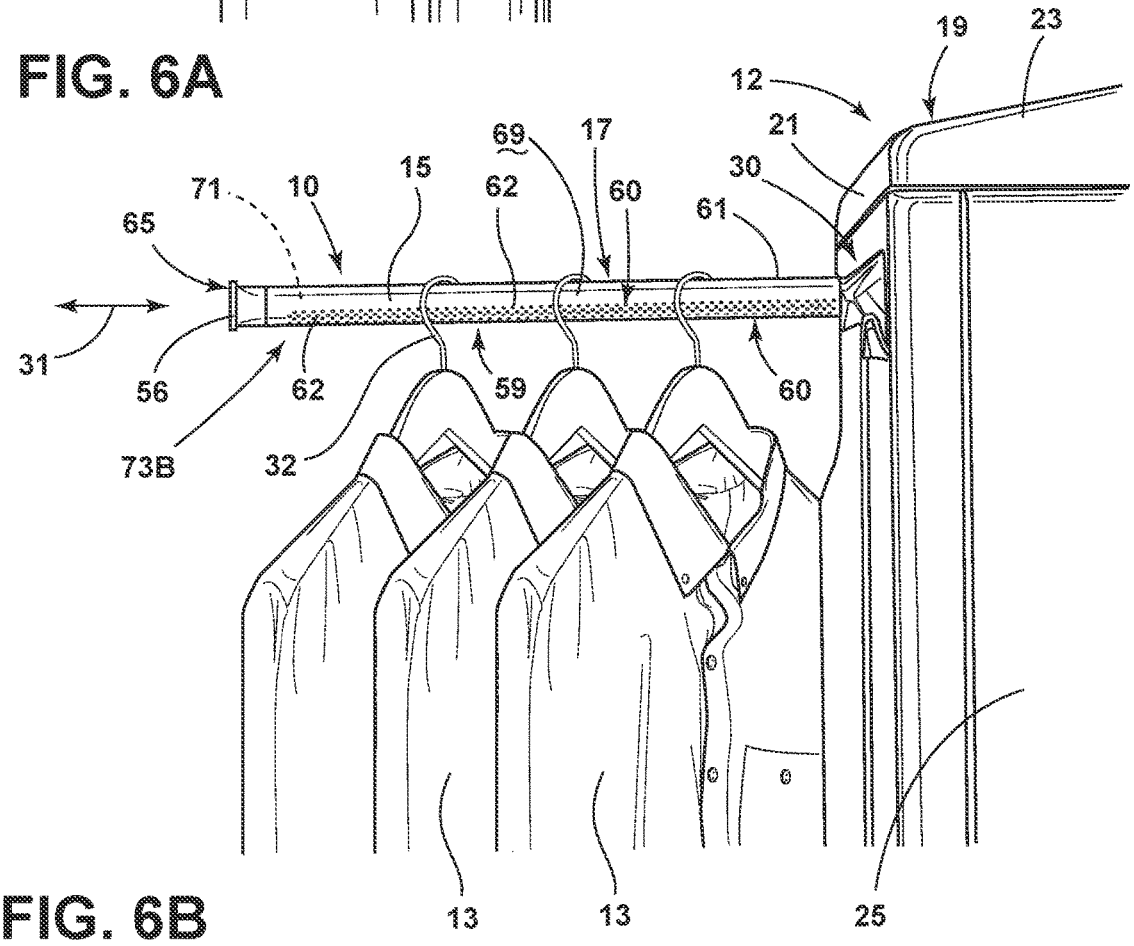
FIG. 6B is a partial, side view of the laundry appliance with the accessory bar assembly of FIG. 6A according to various aspects described herein.

Referring now to FIGS. 6A and 6B, another exemplary accessory bar assembly 10 in the form of a rail 15 is illustrated. The accessory bar assembly 10 can slide in and out of the accessory port 30 on the cabinet 16 for storage and use positions 73*a*, 73*b*, respectively. FIGS. 6A and 6B illustrate the accessory bar assembly 10 in use positions 73*b*, which can include variable lengths extending from the cabinet 16. Again, the user can push the accessory bar assembly 10 to eject, or extend, the accessory bar assembly 10 from the cabinet 16, which may include a push-latch mechanism. Alternatively, the accessory bar assembly 10 can be pulled to extend it from the cabinet 16. In addition, various indicia 65 can be included on the surface of the end portion 56 to inform the user as to the presence or status of the accessory bar assembly 10. This indicia 65 can be a surface indication as well as an illuminated indicia 65. Changes in the accessory air 18 moving through the accessory bar assembly 10 can also be reflected in this indicia 65.

The accessory bar assembly 10 can include a plurality of the outlets 60, or vents 62, configured to provide the accessory air 18. As illustrated, the vents 62 are disposed throughout a lower portion 59 of the body 58 of the accessory bar assembly 10 such that the lower portion 59 of the body 58 is covered with the vents 62. In some implementations, an upper portion 61 of the body 58 may not include the vents 62.

According to some aspects of the device, a flow rate of the accessory air 18 is a function of a size, interior dimensions, or interior diameter, of the accessory bar assembly 10 and the corresponding number and size of the outlets 60. For example, larger accessory bar assemblies 10 may include a lesser amount of outlets 60, while smaller, or narrower accessory bar assemblies 10 may include a greater amount of outlets 60 and include similar flow rates of the accessory air 18. However, the blower 14 can be configured to operate at a variety of speeds, or levels, to increase or decrease the flow rate of accessory air 18 as needed. For example, the accessory bar assembly 10 can include controls to operate at low, medium, and high speed settings, as well as gradual flow rate variations therebetween. In addition, the flow rate of the accessory air 18 through the outlets 60 or vents 62 can vary depending on how far the accessory bar assembly 10 is extracted from the cabinet. For example, as the accessory bar assembly 10 is extracted from the port 30, more outlets and vents 60, 62 are revealed. The amount of accessory air 18 delivered to the accessory bar assembly 10 can increase to maintain a consistent pressure and velocity of accessory air 18 leaving the outlets and vents 60, 62.

Accordingly, the accessory port 30 can include an interior sleeve 67 that engages the exterior surface 69 or this interior surface 71 of the accessory bar assembly 10. In this manner, the interior sleeve 67 can close off those outlets 60 and vents 62 that are within the interior sleeve 67. As the accessory bar assembly 10 is extracted to one of the use positions 73*b*, greater numbers of the outlets 60 and ports 62 are extracted from the interior sleeve 67 and opened to allow for the movement of accessory air 18 to move therethrough. Through this configuration, the interior sleeve 67 of the accessory port 30 and the accessory bar assembly 10 cooperate to vary the pressure of accessory air 18 and increase or decrease the air flow through those outlets 60 and ports 62 that are exposed in the particular use position 73*b* that is being utilized.

Figure 7A:
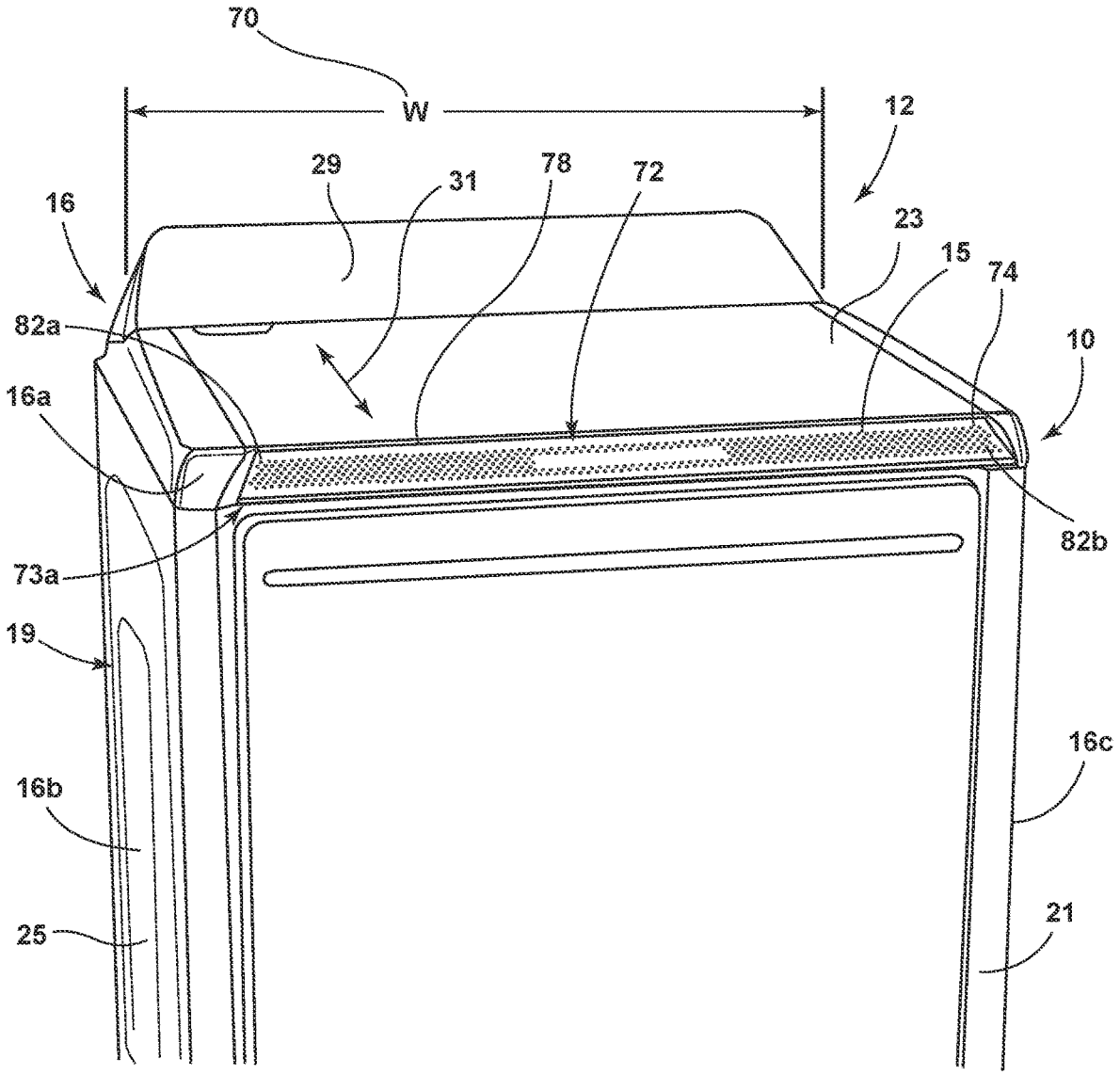
FIG. 7A is a partial, front, perspective view of a laundry appliance with an accessory bar assembly, shown in a retracted position, according to various aspects described herein.
Figure 7B:
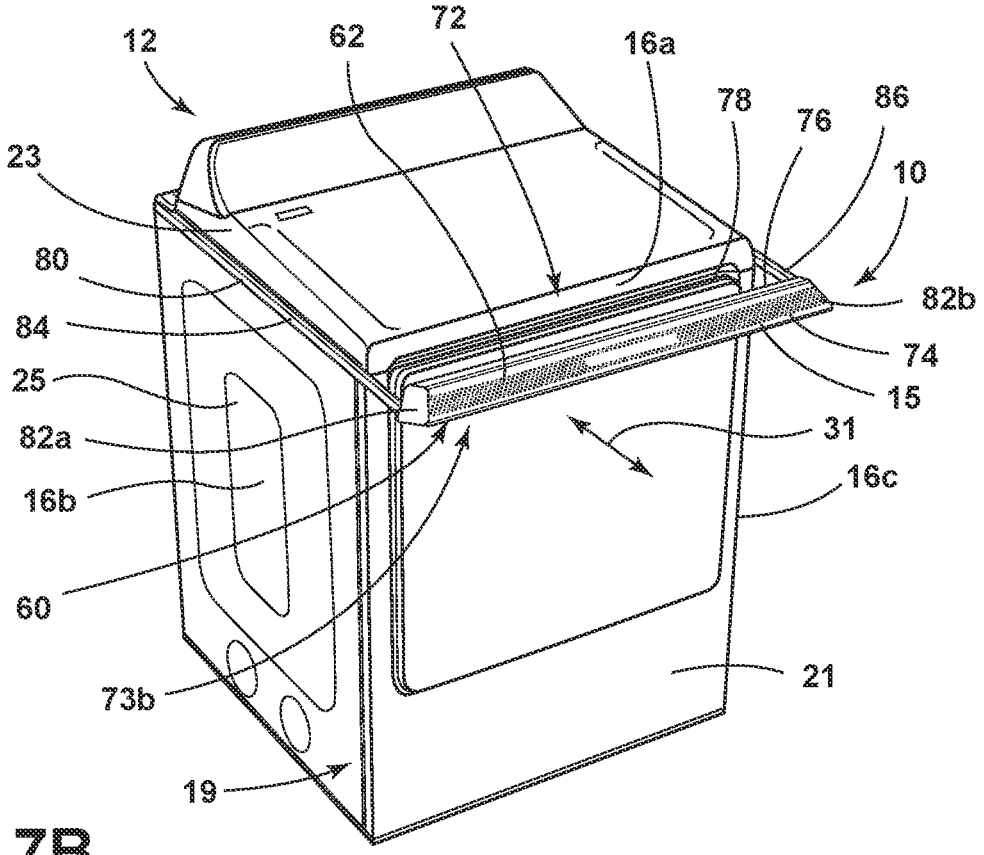
FIG. 7B is a perspective view of a laundry appliance with an accessory bar assembly, shown in an extended position, according to various aspects described herein.
Figure 7C:
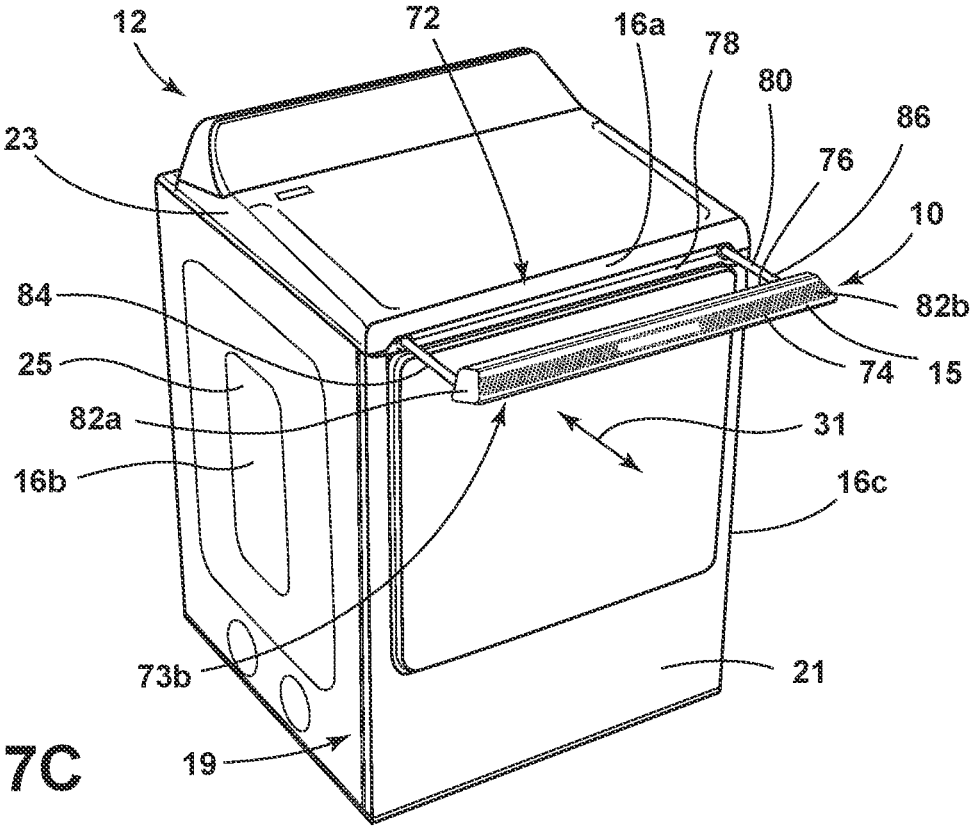
FIG. 7C is a perspective view of the laundry appliance with the accessory bar assembly of FIG. 7A according to various aspects described herein.

FIGS. 7A-7C illustrate yet another exemplary accessory bar assembly 10 in the form of a rail 15 that extends in a transverse direction across the front portion 19 of the cabinet 16. In this way, the accessory bar assembly 10 extends along a width 70 of the cabinet 16 at an upper end 72 thereof. The accessory bar assembly 10 is configured to telescope, or slide fore and aft for storage and use positions 73*a*, 73*b*, respectively. FIG. 7A illustrates the accessory bar assembly 10 in the storage position 73*a*, while FIGS. 7B and 7C illustrate the accessory bar assembly 10 in the use position 73*b*, which may include various lengths extending from the cabinet 16.

The accessory bar assembly 10 may include a generally planar front surface 74 and a back surface 76 configured to be received within a receptacle 78 that forms a receptacle 78 for the accessory bar assembly. This receptacle 78 extends transversely along the upper end 72. The front surface 74 can also accommodate the surrounding contours of the outer cabinet so that the accessory bar assembly 10 is in a flush configuration within a receptacle 78 of the cabinet. Accordingly, the accessory bar assembly 10 can be disposed within the cabinet 16 such that the accessory bar assembly 10 is substantially flush with an outer surface 16*a* of the cabinet 16. However, the accessory bar assembly 10 can be configured to project from the outer surface 16*a* of the cabinet 16 such that the accessory bar assembly 10 is not substantially flush with the outer surface 16*a*. For example, the laundry appliance 12 may not include the receptacle 78.

Furthermore, a transverse body 80 of the accessory bar assembly 10 includes ends 82*a*, 82*b*. The ends 82*a*, 82*b* can be coupled with first and second supports 84, 86, respectively. The first and second supports 84, 86 can be slidingly engaged with the cabinet 16 to support the accessory bar assembly 10. In some implementations, the first and second supports 84, 86 are disposed along sides 16*b*, 16*c* of the cabinet 16, which is illustrated in FIG. 7B. In other implementations, the first and second supports 84, 86 are disposed within the cabinet 16, which is illustrated in FIG. 7C. As illustrated, the outlets 60, or vents 62, are disposed on the transverse body 80. The outlets 60 can be disposed on the front surface 74 and/or the back surface 76 of the accessory bar assembly 10.

Figure 8A:
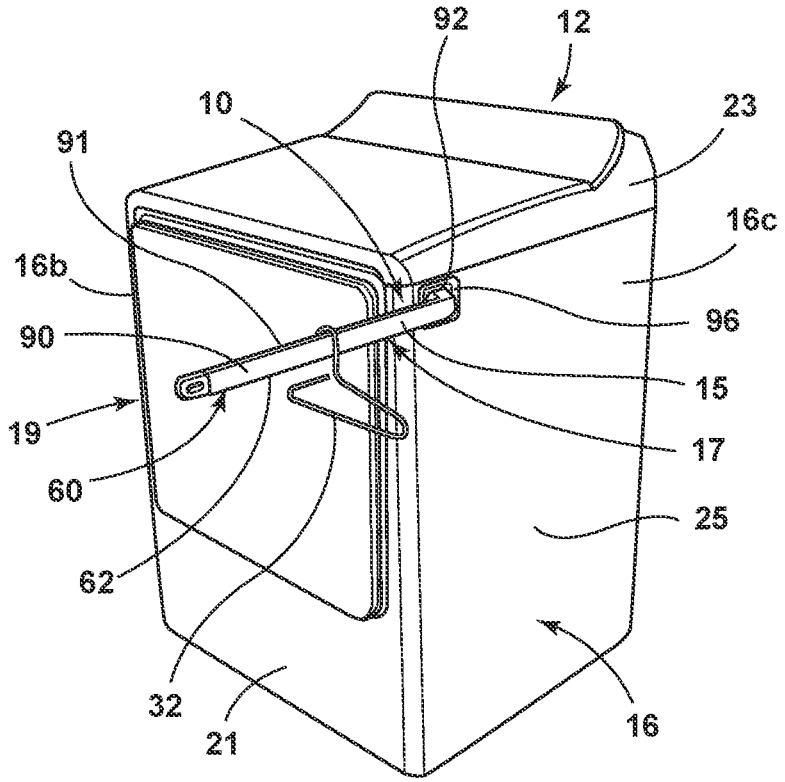
FIG. 8A is a side perspective view of a laundry appliance with an accessory bar assembly, shown attached to the accessory port, according to various aspects described herein.
Figure 8B:
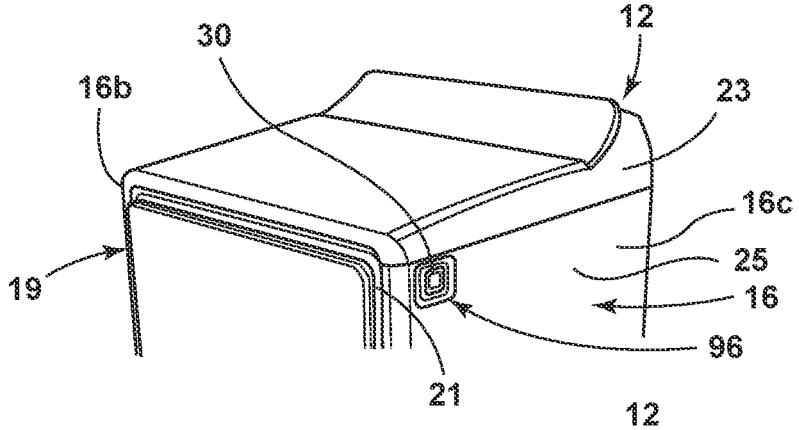
FIG. 8B is a partial, perspective view of the laundry appliance of FIG. 8A according to various aspects described herein.
Figure 8C:
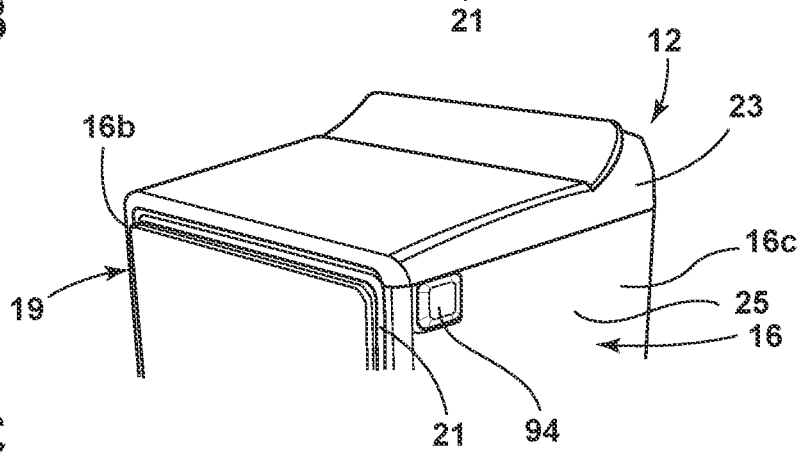
FIG. 8C is a partial, perspective view of the laundry appliance of FIG. 8A according to various aspects described herein.

FIGS. 8A-8C illustrate yet another exemplary accessory bar assembly 10 in the form of a removable bar 91, such as an extension or a wand. The accessory bar assembly 10 can include a body 90 having an end 92 configured to selectively couple the accessory port 30. FIG. 8A illustrates the accessory bar assembly 10 coupled with the accessory port 30. The body 90 may include the outlets 60 in any suitable configuration. In some aspects, the accessory bar assembly 10 can be coupled at various positions around the accessory port 30 such that the accessory bar assembly 10 includes a variety of use positions 73*b* than can define various lengths and angles of operation with respect to the cabinet 16. While illustrated as positioned substantially parallel with a top 16*d* of the cabinet 16, the accessory bar assembly 10 can be positioned generally perpendicular with the top 16*d*, or at angles between perpendicular and parallel with the top 16*d*.

FIGS. 8B and 8C illustrate the accessory bar assembly 10 removed from the accessory port 30. As shown in FIG. 8C, the laundry appliance 12 can include a cover 94, or cap, configured to conceal the accessory port 30 when the accessory bar assembly 10 is not in use. The side 16*c* of the cabinet 16 may include a depression 96 configured to receive the cover 94. When coupled with the accessory port 30, the accessory bar assembly 10 operates in a similar fashion to that of other aspects of the accessory bar assembly 10, as described herein. It is also contemplated that the accessory bar assembly 10 can be received within a receptacle 78 defined within or otherwise incorporated in the cabinet 16 for the appliance 12.

Figure 9A:
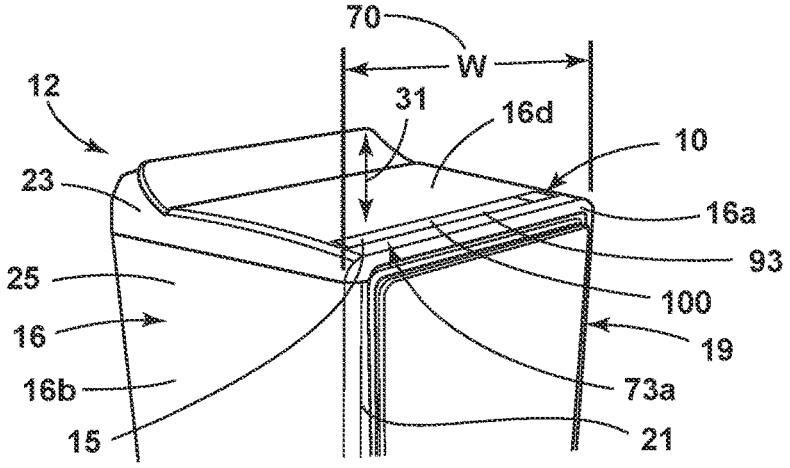
FIG. 9A is a partial, side perspective view of a laundry appliance with an accessory bar assembly, shown in a retracted position, according to various aspects described herein.
Figure 9B:
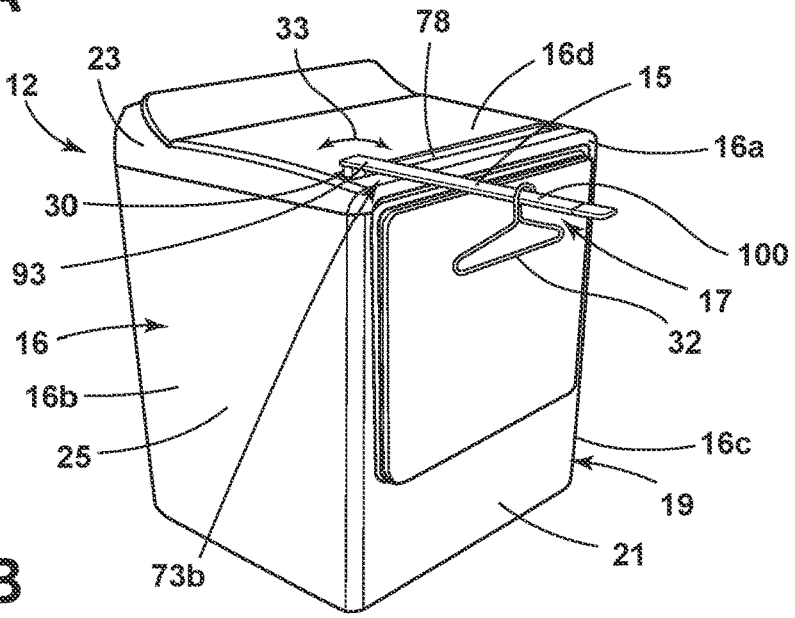
FIG. 9B is a side perspective view of the laundry appliance of FIG. 9A, and shown in a deployed position, according to various aspects described herein.
Figure 9C:
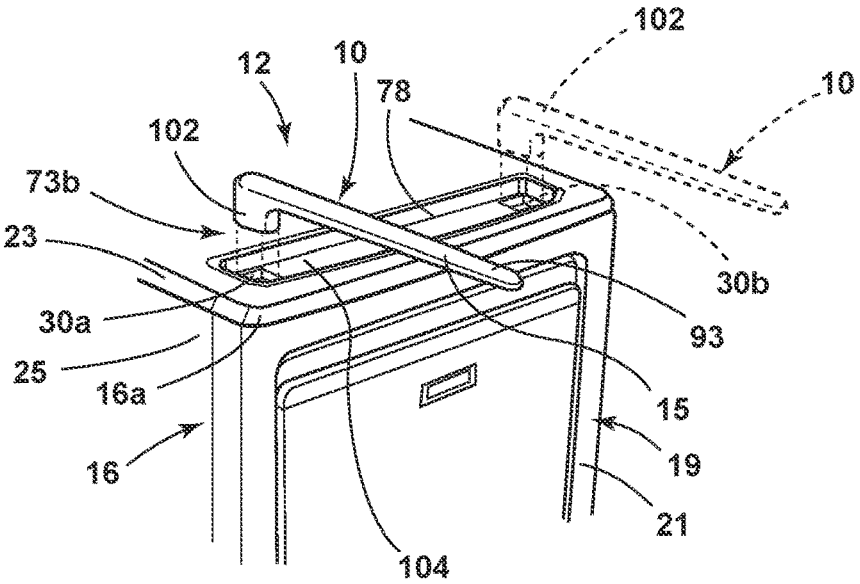
FIG. 9C is a partial, perspective view of a laundry appliance with an accessory bar assembly according to various aspects described herein.

Referring now to FIGS. 9A-9C, another exemplary accessory bar assembly 10 in the form of a pop-up bar 93, or wand, is illustrated. The accessory bar assembly 10 can include a body 100 having an end 102 coupled with the accessory port 30. The end 102 can be rotatably engaged with the accessory port 30 such that the accessory bar assembly 10 can extend from the cabinet 16 at a variety of positions. The end 102 can be fixed in position with respect to the accessory port 30. It is within the scope of the disclosure for the laundry appliance 12 to include more than one accessory port 30. The accessory bar assembly 10 can be fixed in position at two ends 102, each of which can be coupled with an accessory port 30. Alternatively, the accessory bar assembly 10 can be fixed in position at a single end 102, which can optionally couple a first accessory port 30*a* or a second accessory port 30*b*. Therefore, the accessory bar assembly 10 can be reversible, in order to be repositioned into a desired orientation. Further, the outlets 60 can be disposed on any suitable location, including the body 100 of the accessory bar assembly 10. It is contemplated that the accessory bar assembly 10 can be operable in both a linear motion 31 and a rotational motion 33 to manipulate the accessory bar assembly 10 between the storage position 73*a* and the use position 73*b*. As exemplified in FIGS. 9A-9C, this can be characterized as a linear motion 31 that lifts the accessory bar assembly 10 from the storage position 73*a* within the receptacle 78, and a rotational motion 33 that rotates the accessory bar assembly 10 to one of the use positions 73*b*.

According to some aspects, a user can push the accessory bar assembly 10 to pop-up, lift, or project, the accessory bar assembly 10 from the cabinet 16. A push-latch mechanism (e.g. a push-push mechanism) can be actuated to pop-up the accessory bar assembly 10. In this way, a user can push the accessory bar assembly 10 into a use position 73*b*. The accessory bar assembly 10 can be rotated about the end 102 once raised from the storage position 73*a*. The top 16*d* of the cabinet 16 can include a receptacle 78 that can also include an air delivery channel 104. The receptacle 78 can extend along the width 70 of the cabinet 16 that is configured to receive the body 100. When in the storage position 73*a* within the receptacle 78, the body 100 can be flush with the top 16*d* of the cabinet 16 in the storage position 73*a*. In certain aspects of the device, the accessory bar assembly 10 is configured to slide along the air delivery channel 104 that extends between the first and second accessory ports 30*a*, 30*b*. In such an aspect of the device, the accessory bar assembly 10 can extend from any portion of the air delivery channel 104. The air delivery channel 104 can include a series of operable members or operable conduits that allow for the movement of the accessory bar assembly 10 within the air delivery channel 104 without releasing accessory air 18 away from the accessory bar assembly 10. Accordingly, the accessory bar assembly 10 can be stored within the air delivery channel 104 that is defined within the cabinet 16 when not in use.

FIGS. 10A-10D illustrate yet another exemplary accessory bar assembly 10 in the form of a pair of bars. The accessory bar assembly 10 can include a first air bar 110 and a second air bar 112 that are configured to rotate about a first attaching end 114 and a second attaching end 116, respectively, to and from storage and use positions 73*a*, 73*b* relative to the cabinet 16. In this manner, the first air bar 110 and the second air bar 112 can be vertically aligned to define an upper first air bar 110 and a lower second air bar 112. It is also contemplated that the first and second air bars 110, 112 can be configured in a lateral alignment. The first and second attaching ends 114, 116 can be rotatably coupled with the cabinet 16. According to some aspects of the device, a housing 118 is disposed on a side (e.g. side 16*c*) of the cabinet 16. The housing 118 is configured to receive, or store, the first air bar 110 and the second air bar 112 when not in use, which is shown generally in FIG. 10B. The housing 118 can be in fluid communication with one or more of the accessory ports 30. Optionally, the first air bar 110 and the second air bar 112 are each directly coupled with the accessory ports 30. In certain aspects of the device, the first and second air bars 110, 112 can be slidably operable with respect to the cabinet 16 to extend and retract therefrom.

As illustrated, first and second attaching ends 114, 116 of the first and second air bars 110, 112 are attached, or coupled with, the cabinet 16. In this way, the accessory bar assembly 10 is configured to form an air curtain 120 that extends within a processing space that is defined between the first and second air bars 110, 112. When the first and second air bars 110, 112 are rotated away from the cabinet 16, the first and second air bars 110, 112 are positioned generally parallel to a floor surface. The first air bar 110 includes a first body 122 and the second air bar 112 includes a second body 124. The first and second bodies 122, 124 include the outlets 60. During use, the accessory air 18 flows from the outlets 60, thereby forming the air curtain 120 between the first air bar 110 and the second air bar 112.

Figure 10A:
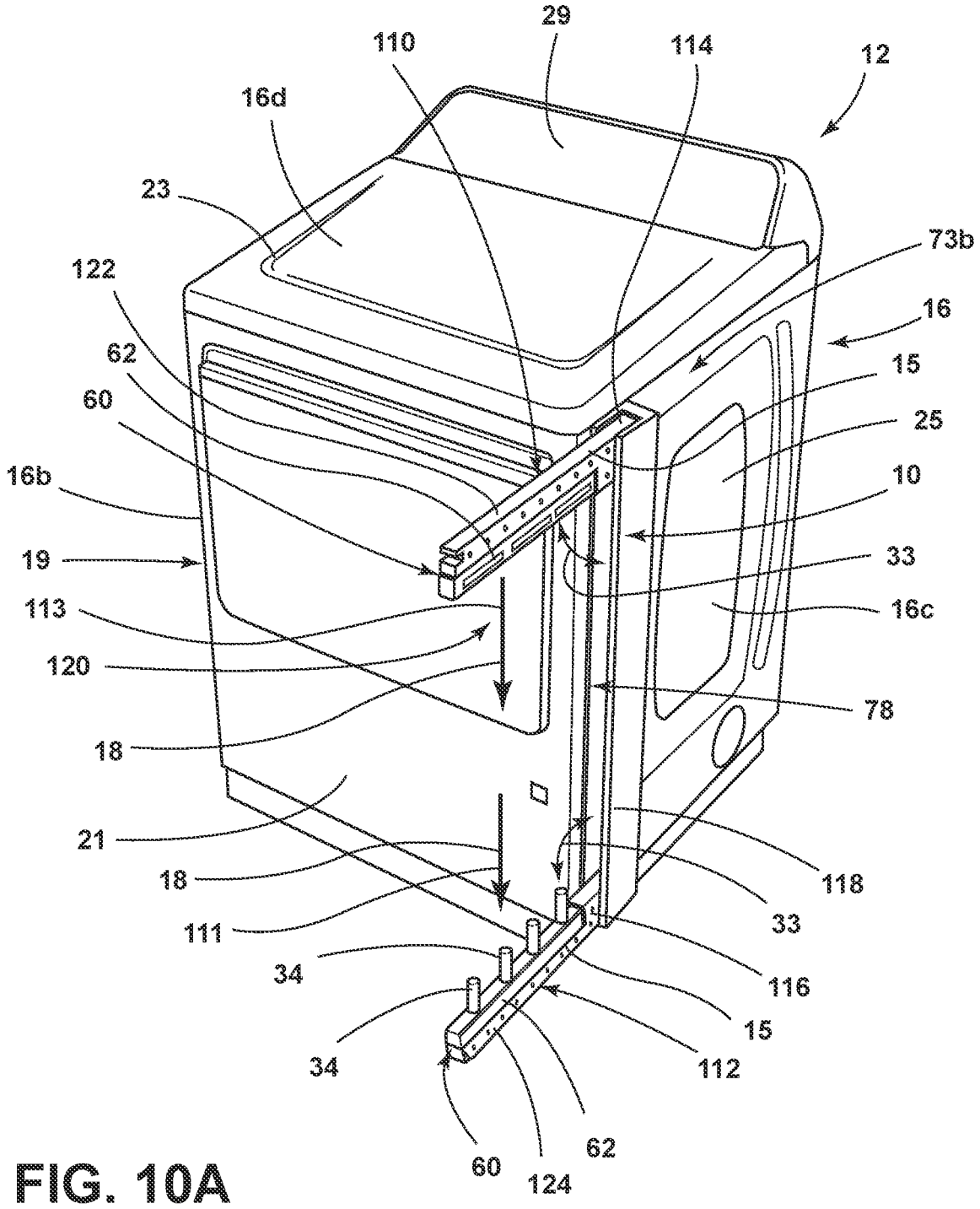
FIG. 10A is a top perspective view of a laundry appliance with an accessory bar assembly, shown in a deployed position, according to various aspects described herein.
Figure 10B:
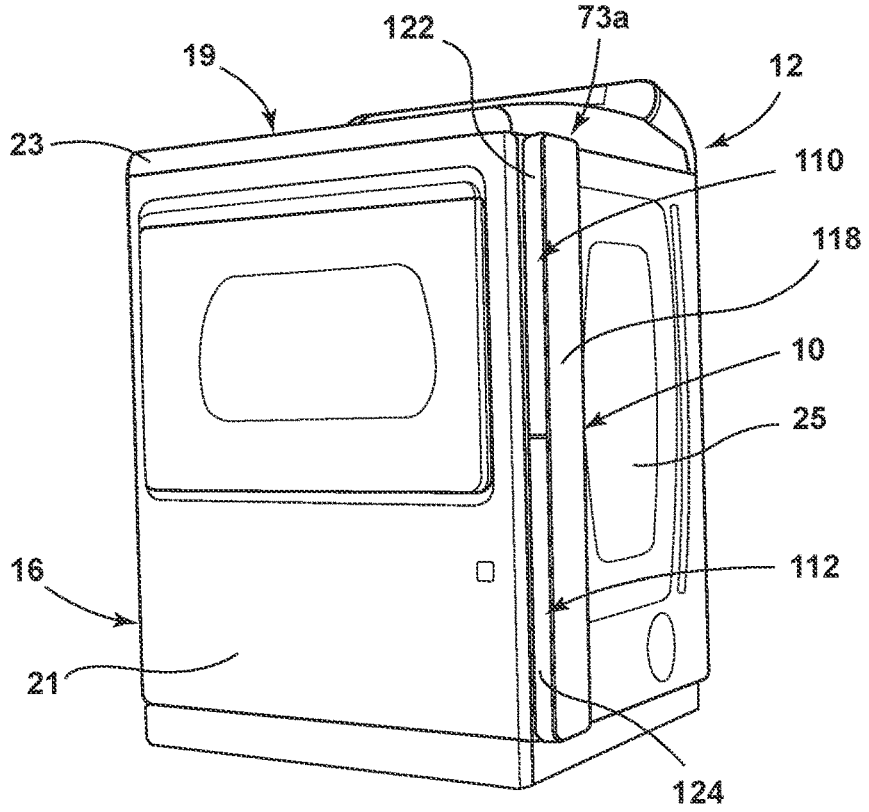
FIG. 10B is a perspective view of the laundry appliance with the accessory bar assembly of FIG. 10A, shown in a retracted position, according to various aspects described herein.
Figure 10C:
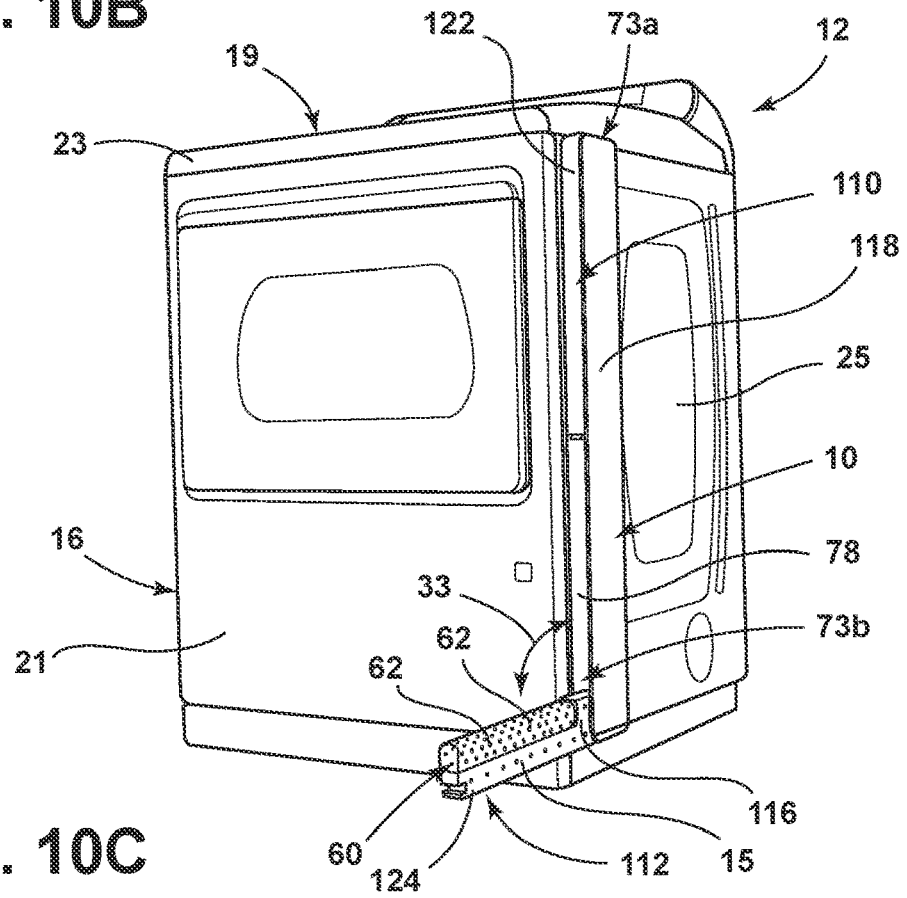
FIG. 10C is a side perspective view of a laundry appliance with an accessory bar assembly, shown in a partially deployed position, according to various aspects described herein.
Figure 10D:
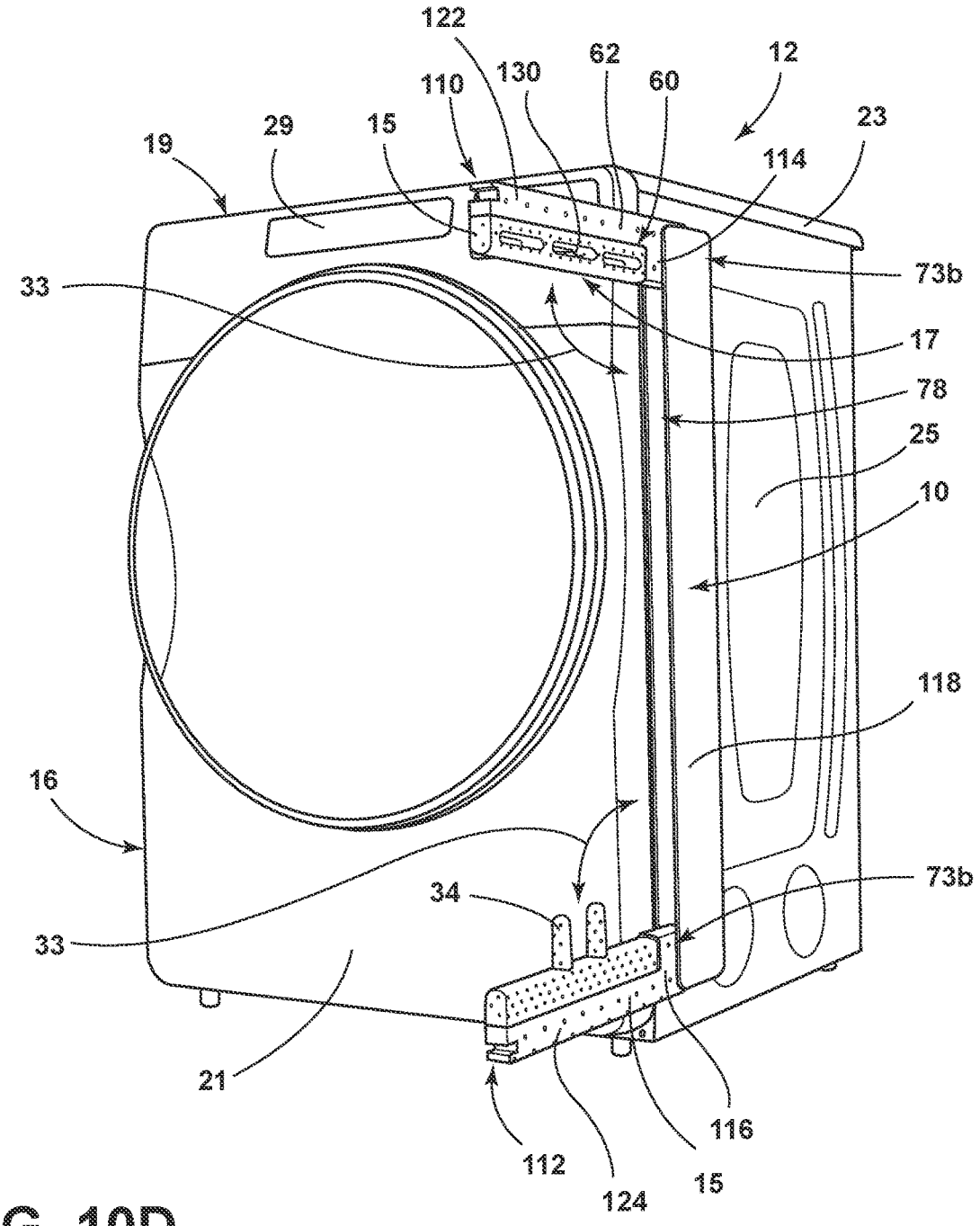
FIG. 10D is a side perspective view of a laundry appliance with an accessory bar assembly, shown in an extended position, according to various aspects described herein.

The accessory bar assembly 10 can further include the pegs 34. The pegs 34 can accommodate garments such as footwear. According to some aspects, the second air bar 112 can be disposed lower than the first air bar 110 and include a plurality of the pegs 34, which can be spaced apart and extending upward. Any suitable number of pegs 34 can be included on the accessory bar assembly 10. However, the accessory bar assembly 10 may not include the pegs 34, which is illustrated in FIG. 10C. Optionally, the accessory bar assembly 10 can define apertures 130 configured to receive hangers and the like for suspending the articles 13 therefrom. Additionally, articles 13 can be draped over either or both of the first and second air bars 110, 112 for drying with the accessory air 18.

In certain aspects of the device, the flow of the accessory air 18 relative to the first and second air bars 110, 112 can be configured and adjusted for different functions. The accessory air 18 can be directed to flow in an outward direction from the first and second bodies 122, 124. In this configuration, the accessory air 18 is used to dry articles 13 that are positioned on each of the first and second air bars 110, 112. It is also contemplated that the accessory air 18 can be configured to flow in an outward direction (positive flow 113) with respect to one of the first and second air bars 110, 112 and directed inward (suction 111) with respect to the other of the first and second air bars 110, 112. In such a configuration, the accessory air 18 forms a continuous air curtain 120 that flows in an upward direction or in a downward direction between the first and second air bars 110, 112. In this manner, the air curtain 120 can be used to direct the air curtain 120 through and around hanging articles. In such a configuration, the air curtain 120 can be adapted to periodically reverse direction between an upward flow and a downward flow. The first and second air bars 110, 112 can also direct separate air curtains 120 toward one another and within the processing space.

Figure 11A:
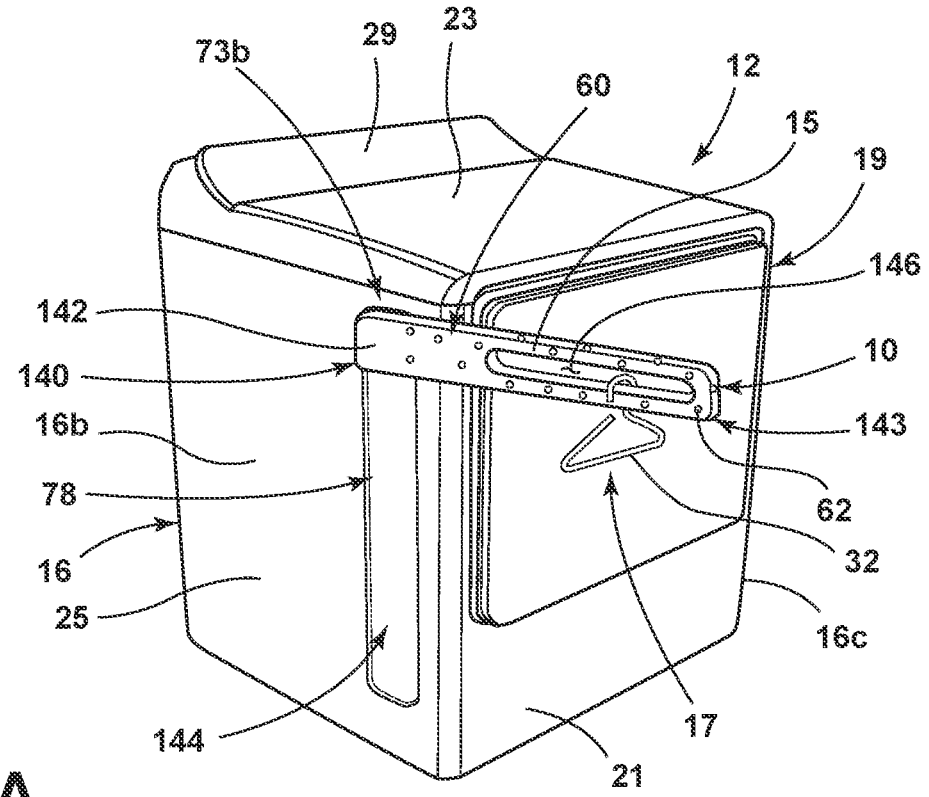
FIG. 11A is a side perspective view of a laundry appliance with an accessory bar assembly, shown in an extended position, according to various aspects described herein.
Figure 11B:
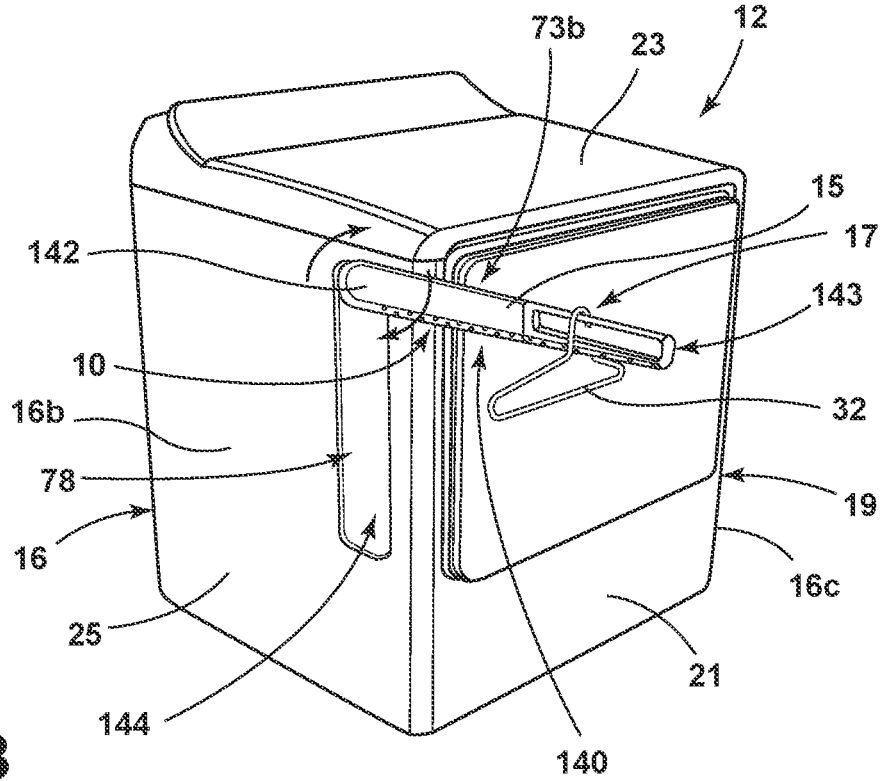
FIG. 11B is a side perspective view of a laundry appliance with an accessory bar assembly, shown in an extended position, according to various aspects described herein.

FIGS. 11A-11B illustrate yet another exemplary accessory bar assembly 10 in the form of a rotatable bar. The accessory bar assembly 10 can be similar to the accessory bar assembly 10 and the accessory bar assembly 10. The accessory bar assembly 10 includes a single air bar 140 that is configured to swing about an attached, or upper end 142, which can be rotatably coupled with a side (e.g. side 16*b*) of the cabinet 16. Thus, the accessory bar assembly 10 can be moved from a vertically-oriented storage position 73*a* to a horizontally-oriented use position 73*b*. In the horizontal use position 73*b*, a free end 143 extends away from the cabinet 16. The side 16*b* of the cabinet 16 can include a depression 144 configured to receive and retain the accessory bar assembly 10. The air bar 140 includes the outlets 60. According to some aspects, the air bar 140 defines an opening 146, or an aperture, configured to receive hangers and the like for suspending the articles 13 therefrom. The opening 146 can extend along at least a portion of the length of the air bar 140 at the free end 143.

According to the various aspects of the device, the accessory bar assembly 10 can be placed within the storage position 73*a* within a receptacle 78 that is defined within the surface of the cabinet 16. In this aspect of the device, the accessory bar assembly 10 is typically externally visible. The accessory bar assembly 10 can also be visually camouflaged or otherwise obfuscated to blend in to the surrounding area of the cabinet 16. The receptacle 78 can also be defined within an interior portion of the cabinet 16. In this aspect of the device, the accessory bar assembly 10 can retract, at least partially to an area within the cabinet 16. The accessory bar assembly 10, in this configuration, can have an end piece that is externally visible, while the remainder of the accessory bar assembly 10 is stowed within the cabinet 16, until extracted from the receptacle 78.

Figure 12:
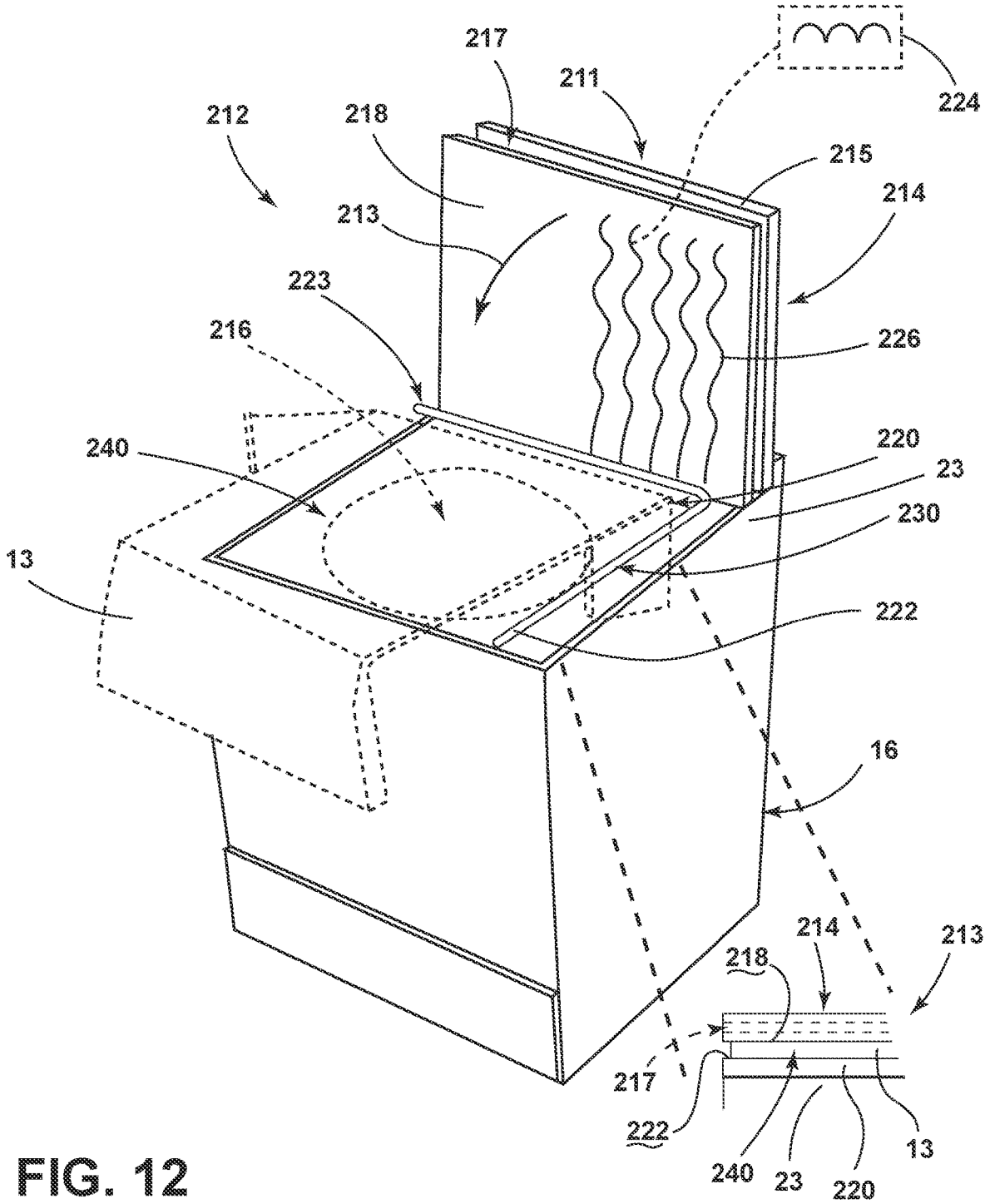
FIG. 12 is a side perspective view of a laundry appliance with a removable panel assembly according to various aspects described herein.

Referring now to FIG. 12, a laundry appliance 212 is illustrated according to various aspects of the present disclosure. In some examples, the laundry appliance 212 is a vertical axis laundry machine including a lid 214 rotatable between a raised position 211 to a lowered position 213, where the lid 214 selectively covers an access opening 216. The lid 214 can include a substantially flat, or planar, lower surface 218. The laundry appliance 212 can further include a panel 220 configured to be situated upon, or over, the access opening 216 to define a processing state that forms a wrinkle processing space 240. The panel 220 is typically removable or operable to be moved over the access opening 216 and away from the access opening 216. The panel 220 can include a substantially flat upper surface 222. According to some aspects, the panel 220 is selectively attachable to the laundry appliance 212 and can include a tray configuration. Also, in certain aspects of the device, the panel 220 can be integral with the outer frame 215 of the lid 214 such that the outer frame 215 and the panel 220 defines the wrinkle processing space 240 between the lower surface 218 and the upper surface 222. In this manner, the lid 214 having the outer frame 215 the panel 220 forms a hinged configuration that allows for rotational separation of the lower surface 218 and the upper surface 222 to define the wrinkle processing space 240.

In use, as a non-limiting example, the lower surface 218 and the upper surface 222 can be separated from each other to insert the article 13 therebetween and within the wrinkle processing space 240. In a non-limiting alternative, the panel 220 can be removable from a storage space 217 defined by the lid 214 such that the panel 220 can be slid out from the storage space 217 of the lid 214 and placed over the access opening 216. The lower surface 218 and the upper surface 222 can be made of any suitable material, including, but not limited to, glass, ceramic, metals, various polymers, combinations thereof and other similar materials.

According to some aspects, a rail docking system 223 is provided, which can be located near a lid hinge area. The rail docking system 223 can selectively dock, or connect, the panel 220 to the laundry appliance 212. The rail docking system 223 can include a spring mechanism configured to couple the panel 220 to the laundry appliance 212. It is also contemplated that the panel 220 is electrically coupled to the laundry appliance 212 when docked. In this manner, the panel 220 can utilize electromagnetic induction that may not require a wired connection between the panel 220 and an assembly for delivering electrical power to heat the panel 220.

A heating element 224 is configured to heat at least one of the lower surface 218 of the lid 214 and the upper surface 222 of the panel 220. In some aspects, both of the lower surface 218 of the lid 214 and the upper surface 222 of the panel 220 are heated. In some implementations, the heating element 224 includes hot water, typically in the form of steam. In such an aspect of the device, at least one of the lid 214 and the top panel 23 can include one or more steam nozzles that can be used to selectively direct one or more jets of steam onto the wrinkle processing space 240 to assist in the processing of laundry articles 13.

In other implementations, the heating element 224 includes a plurality of electrically inductive or electrically resistive wires 226 integrated within the lid 214 and/or the panel 220. Additionally, the heating element 224 can provide a variable amount of heat. The heat used within the wrinkle processing space 240 can be produced by the heating element 224. It is also contemplated that at least a portion of the heat for the wrinkle processing space 240 can be delivered into the wrinkle processing space 240 from within the cabinet 16 of the laundry appliance 212, or from an external source, such as a drying appliance positioned near the laundry appliance 212 having the wrinkle processing space 240.

The lower surface 218 of the lid 214 and the upper surface 222 of the panel 220 are pressed together upon closing of the lid 214. In this way, the lid 214 and the panel 220 work similar to an iron or clothing press to dry and smooth wrinkles from the article 13. In this manner, the upper surface 222 and the lower surface 218 are generally parallel with one another. It is also contemplated that at least one of the upper surface 222 and the lower surface 218 can be able to conform to the general shape of the article 13 positioned within the wrinkle processing space 240. In such a configuration, the lower surface 218 and/or the upper surface 222 can be attached to the panel 220 and the lid 214, respectively, via an operable connection, such as a ball joint that allows for some operable movement to define the wrinkle processing space 240.

The use of the lid 214 and the panel 220 of the laundry appliance 212 can reduce or eliminate the need for an additional drying process, such as separate drying, ironing, refreshing or steaming. The laundry appliance 212 can include a runoff channel 230 configured to direct water removed from the article 13 into a drain or recirculation line of the laundry appliance 212.

Figure 13A:
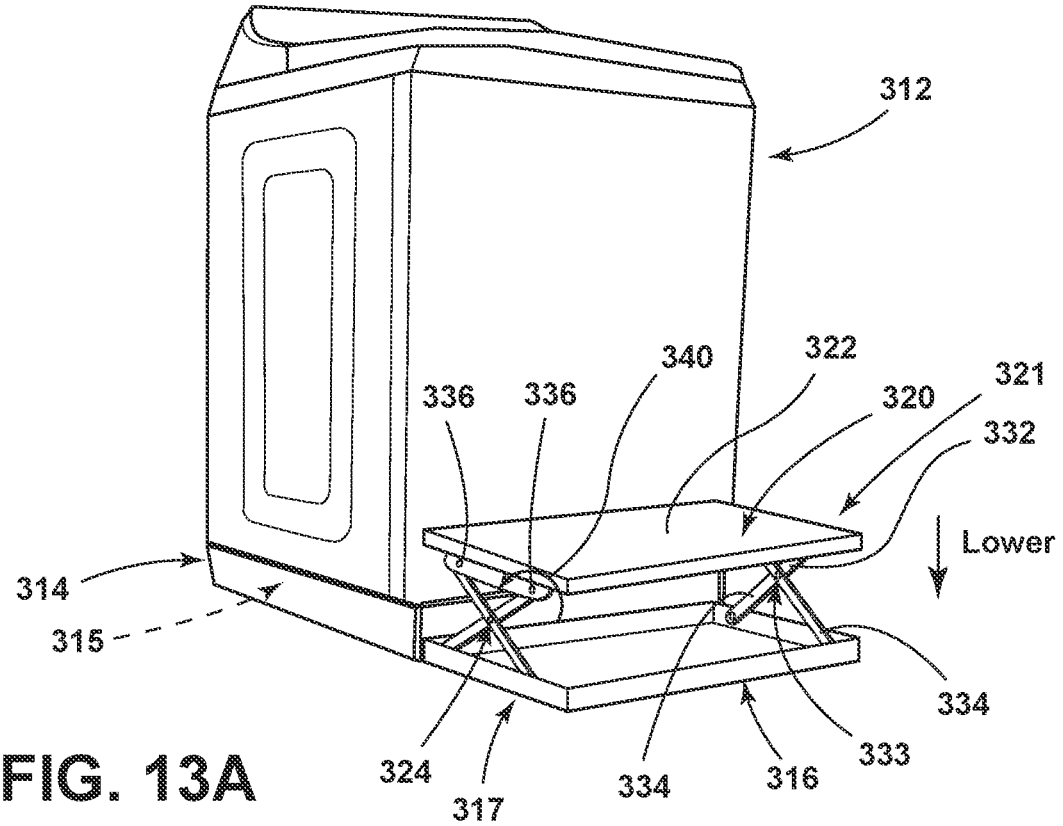
FIG. 13A is a side perspective view of a laundry appliance with a step assembly according to various aspects described herein.
Figure 13B:
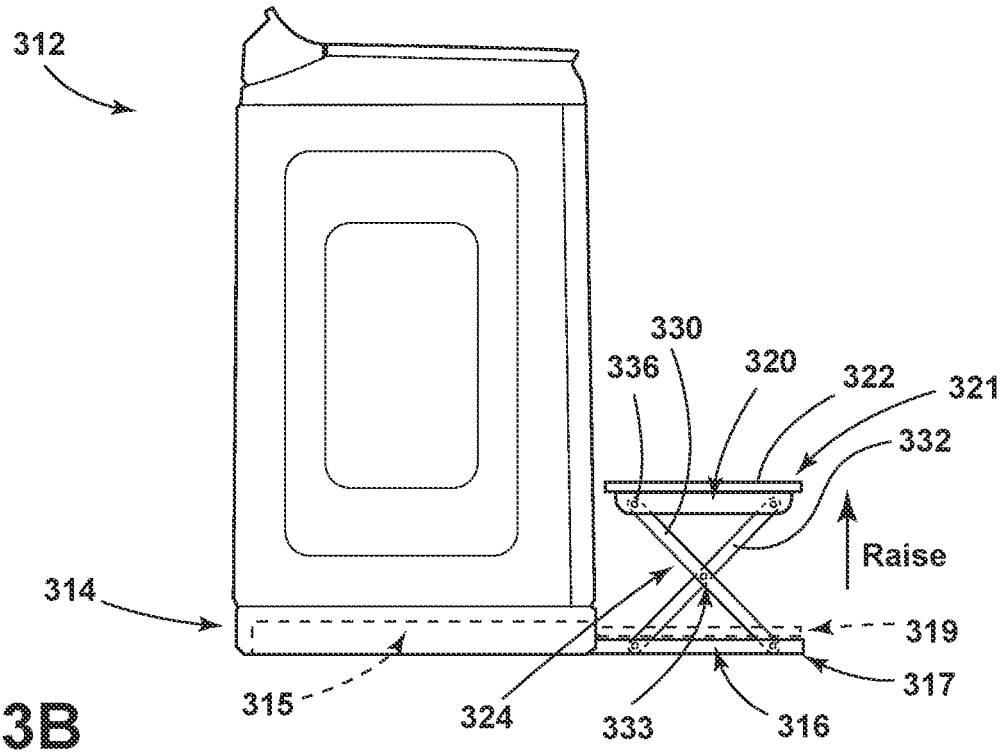
FIG. 13B is a side elevation view of the laundry appliance of FIG. 13A according to various aspects described herein.

Referring to FIGS. 13A and 13B, a laundry appliance 312 is illustrated according to various aspects of the present disclosure. In some examples, the laundry appliance 312 is a vertical axis laundry machine including a base that is incorporated within the cabinet 16. The cabinet 16 can also rest on a riser 314, or pedestal. The riser 314 is configured to lift the laundry appliance 312 off the floor surface. A drawer, or tray 316, can be disposed within the base and can be extendable from the cabinet 16 between a stowed position 315, within the base or within the riser 314, and a supporting position 317 in front of the cabinet 16. The tray 316 can also be configured to be disposed within the riser 314 and be extendable from the riser 314 and within an area below the cabinet 16. According to various aspects, a step 320 is disposed within the tray 316. The step 320 can include a planar upper surface 322 that bears weight of a user. In some aspects, a user can pull the step 320 upwards to raise the step 320 from the flat position 319 to the step position 321.

The laundry appliance 312 can include scissor hinge assemblies 324 on sides of the tray 316 that are configured to move the step 320 up to the step position 321 and down to the flat position 319. In the flat position 319, the tray 316 is nested within the tray 316 and is able to be operated between the stowed position 315 and the supporting position 317. The scissor hinge assemblies 324, such as a scissor linkage can include a first rod 330 and a second rod 332 crossed over each other in the shape of an "X." The first rod 330 and the second rod 332 can be rotatably coupled at middle portions 333 thereof. A lower end 334 of each of the first and second rods 330, 332 can be fixed in positon relative to the tray 316. Upper ends 336 of each of the first and second rods 330, 332 can be slidably coupled to the step 320. As such, the first and second rods 330, 332 can extend upwards to the step position 321 and lower to the flat position 319. Additionally, the scissor hinge assemblies 324 can include a locking mechanism 340 configured to fix the step 320 in the step position 321 such that the step 320 can be configured to bear weight of a user.

Benefits of various aspects described herein may include a variety of assemblies configured to dry articles 13 without using a conventional tumble dry process while also consolidating space utilized in a laundry area. Thus, air drying time may be decreased or eliminated. Additionally, a raised platform in the form of a step 320 integrated into a laundry appliance 12 may provide a user easier access to laundry items within the laundry appliance 12.

According to another aspect of the present disclosure, a laundry appliance includes a cabinet. A blower is disposed within the cabinet that delivers accessory air through an accessory airflow path. An accessory bar assembly is in fluid communication with the accessory airflow path. The accessory bar assembly is configured to suspend articles therefrom and to provide the accessory air for conditioning the articles.

According to another aspect, the accessory bar assembly is in the form of a footwear dryer or a hanging-clothes dryer.

According to yet another aspect, the accessory airflow path includes a diverter valve that selectively delivers process air to the accessory airflow path.

According to another aspect of the present disclosure, the blower also directs process air through a primary airflow path that includes a rotating drum.

According to another aspect, the accessory bar assembly extends from a front portion of the cabinet.

According to yet another aspect, the accessory air is directed within a processing space that is outside of the cabinet and proximate the front portion.

According to another aspect of the present disclosure, the accessory bar assembly includes a plurality of perforations that direct the accessory air from the accessory airflow path and into the processing space.

According to another aspect, the accessory bar assembly includes an upper first air bar and a lower second air bar that are each connected to the accessory airflow path.

According to yet another aspect, the upper first air bar directs the accessory air in a downward direction and into a processing space.

According to another aspect of the present disclosure, the lower second air bar directs the accessory air in an upward direction and into a processing space.

According to another aspect, the accessory bar assembly slidably extends from a receptacle defined within the cabinet.

According to yet another aspect, the receptacle is defined within an outer surface of the cabinet.

According to another aspect of the present disclosure, the receptacle is defined within an interior of the cabinet.

According to another aspect, a vertical axis laundry machine includes a cabinet having a top panel that defines an access opening. A lid is coupled with the top panel and having a lower surface. The lid is operable between a raised position above the access opening and a lowered position that covers the access opening. A removable panel is selectively positioned on the top panel and over the access opening to define a processing state. A heating element is positioned proximate at least one of the lid and the top panel. The heating element is configured to heat at least one of the lower surface of the lid and an upper surface of the removable panel. When the removable panel is in the processing state and the lid is in the lowered position, the lower surface of the lid and the upper surface of the removable panel are pressed together to define a wrinkle processing space for treating articles of clothing.

According to yet another aspect, one of the lid and the top panel includes a steam nozzle that selectively directs a jet of steam into the wrinkle processing space.

According to another aspect of the present disclosure, the lid includes a planar lower surface and the removable panel includes a planar upper surface. The planar lower surface and the planar upper surface are parallel when the removable panel is in the processing state and the lid in the lowered position.

According to another aspect, the lower surface of the lid is operable relative to an outer frame of the lid. The lower surface of the lid is configured to conform to the upper surface of the removable panel in the processing state.

According to yet another aspect, the heating element is positioned within the lid and between the lower surface of the lid and the outer frame of the lid.

According to another aspect of the present disclosure, a vertical axis laundry machine includes a cabinet that includes a base positioned proximate a lower portion of the cabinet. A drawer is disposed within the base and operable between a stowed position within the base and a supporting position forward of the base. A step is disposed within the drawer. The step is attached to the drawer via a scissor linkage. The step is configured to be operable between a flat position and a step position when the drawer is in the supporting position.

According to another aspect, the base is a pedestal that is separate from the cabinet. The pedestal supports the cabinet from below.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a cabinet;

a blower disposed within the cabinet that delivers accessory air through an accessory airflow path; and an accessory bar assembly in fluid communication with the accessory airflow path, wherein the accessory bar assembly is configured to suspend articles therefrom and to provide the accessory air for conditioning the articles, wherein the accessory bar assembly extends from a front portion of the cabinet.

2. The laundry appliance of claim 1, wherein the accessory bar assembly is in the form of a footwear dryer or a hanging-clothes dryer.

3. The laundry appliance of claim 1, wherein the accessory airflow path includes a diverter valve that selectively delivers process air to the accessory airflow path.

4. The laundry appliance of claim 1, wherein the blower also directs process air through a primary airflow path that includes a rotating drum.

5. The laundry appliance of claim 1, wherein the accessory air is directed within a processing space that is outside of the cabinet and proximate the front portion.

6. The laundry appliance of claim 5, wherein the accessory bar assembly includes a plurality of perforations that direct the accessory air from the accessory airflow path and into the processing space.

7. The laundry appliance of claim 1, wherein the accessory bar assembly includes an upper first air bar and a lower second air bar that are each connected to the accessory airflow path.

8. The laundry appliance of claim 7, wherein the upper first air bar directs the accessory air in a downward direction and into a processing space.

9. The laundry appliance of claim 7, wherein the lower second air bar directs the accessory air in an upward direction and into a processing space.

10. The laundry appliance of claim 1, wherein the accessory bar assembly slidably extends from a receptacle defined within the cabinet.

11. The laundry appliance of claim 10, wherein the receptacle is defined within an outer surface of the cabinet.

12. The laundry appliance of claim 10, wherein the receptacle is defined within an interior of the cabinet.

13. A laundry appliance comprising:

a cabinet;

a blower disposed within the cabinet that delivers accessory air through an accessory airflow path; and an accessory bar assembly in fluid communication with the accessory airflow path, wherein the accessory bar assembly is configured to suspend articles therefrom and to provide the accessory air for conditioning the articles, wherein the accessory bar assembly slidably extends from a receptacle defined within the cabinet.

14. The laundry appliance of claim 13, wherein the accessory bar assembly is in the form of a footwear dryer or a hanging-clothes dryer.

15. The laundry appliance of claim 13, wherein the accessory airflow path includes a diverter valve that selectively delivers process air to the accessory airflow path.

16. The laundry appliance of claim 13, wherein the blower also directs process air through a primary airflow path that includes a rotating drum.

17. The laundry appliance of claim 13, wherein the accessory bar assembly extends from a front portion of the cabinet, wherein the accessory air is directed within a processing space that is outside of the cabinet and proximate the front portion, and wherein the accessory bar assembly includes a plurality of perforations that direct the accessory air from the accessory airflow path and into the processing space.

18. The laundry appliance of claim 13, wherein the accessory bar assembly includes an upper first air bar and a lower second air bar that are each connected to the accessory airflow path, wherein the upper first air bar directs the accessory air in a downward direction and into a processing space, and wherein the lower second air bar directs the accessory air in an upward direction and into the processing space.

19. The laundry appliance of claim 13, wherein the receptacle is defined within an outer surface of the cabinet.

20. The laundry appliance of claim 13, wherein the receptacle is defined within an interior of the cabinet.

* * * * *